US012428743B2

(12) United States Patent
Jung et al.

(10) Patent No.: US 12,428,743 B2
(45) Date of Patent: Sep. 30, 2025

(54) POROUS COPPER/COPPER OXIDE XEROGEL CATALYST

(71) Applicants: Saudi Arabian Oil Company, Dhahran (SA); Korea Advanced Institute of Science and Technology, Daejeon (KR)

(72) Inventors: Hee-Tae Jung, Daejeon (KR); Chansol Kim, Daejeaon (KR); Issam Gereige, Thuwal (SA)

(73) Assignees: Saudi Arabian Oil Company, Dhahran (SA); Korea Advanced Institute of Science and Technology, Daejeon (KR)

( * ) Notice: Subject to any disclaimer, the term of this patent is extended or adjusted under 35 U.S.C. 154(b) by 841 days.

(21) Appl. No.: 17/580,388

(22) Filed: Jan. 20, 2022

(65) Prior Publication Data

US 2022/0243342 A1 Aug. 4, 2022

Related U.S. Application Data

(60) Provisional application No. 63/144,778, filed on Feb. 2, 2021.

(51) Int. Cl.

| | |
|---|---|
| ***C25B 11/091*** | (2021.01) |
| ***C25B 3/07*** | (2021.01) |
| ***C25B 3/26*** | (2021.01) |
| ***C25B 3/29*** | (2021.01) |
| ***C25B 11/032*** | (2021.01) |
| ***C25B 11/052*** | (2021.01) |
| ***C25B 11/065*** | (2021.01) |

(52) U.S. Cl.

CPC ..... *C25B 11/091* (2021.01); *C25B 11/032* (2021.01); *C25B 11/052* (2021.01); *C25B 11/065* (2021.01); *C25B 3/07* (2021.01); *C25B 3/26* (2021.01); *C25B 3/29* (2021.01)

(58) Field of Classification Search

CPC ... C25B 11/091; C25B 11/032; C25B 11/052; C25B 11/065; C25B 3/07; C25B 3/26; C25B 3/29; B01J 23/72; C07C 213/02; C07C 215/76

See application file for complete search history.

(56) References Cited

U.S. PATENT DOCUMENTS 4,106,952 A 8/1978 Kravitz
9,461,185 B2 10/2016 Nair et al.
(Continued)

FOREIGN PATENT DOCUMENTS

CN 102736342 10/2012
CN 106140161 8/2018
(Continued)

OTHER PUBLICATIONS

Ortega-Zarzosa et al., "Formation of copper-based particles trapped in a silica xerogel matrix" Superficies y vacío, Dec. 11, 2000, 61-65 (Year: 2000).*

(Continued)

*Primary Examiner* — Anthony J Zimmer
*Assistant Examiner* — Abdul-Rahman Yusuf Waleed Smari
(74) *Attorney, Agent, or Firm* — Fish & Richardson P.C.

(57) ABSTRACT

An electrocatalytic catalyst is provided. The electrocatalytic catalyst includes a xerogel including copper (I) oxide and copper.

26 Claims, 32 Drawing Sheets

2900

(56) References Cited

U.S. PATENT DOCUMENTS

| | | | |
|---|---|---|---|
| 9,640,793 | B2 | 5/2017 | Holme et al. |
| 9,732,986 | B2 | 8/2017 | Al-Ansary et al. |
| 9,778,534 | B2 | 10/2017 | Tran et al. |
| 10,297,698 | B2 | 5/2019 | Chu et al. |
| 2012/0298200 | A1 | 11/2012 | Niggemann et al. |
| 2013/0068217 | A1 | 3/2013 | Al-Ansary et al. |
| 2015/0053266 | A1 | 2/2015 | Chen et al. |
| 2016/0035912 | A1 | 2/2016 | Nair et al. |
| 2016/0180982 | A1 | 6/2016 | Engel-Herbert et al. |
| 2016/0223878 | A1 | 8/2016 | Tran et al. |
| 2017/0155360 | A1 | 6/2017 | Hahn et al. |
| 2018/0212076 | A1 | 7/2018 | Chu et al. |
| 2018/0231861 | A1 | 8/2018 | Franz et al. |
| 2019/0084428 | A1 | 3/2019 | Ebert et al. |
| 2019/0145161 | A1 | 5/2019 | Agrawal et al. |
| 2020/0002828 | A1 | 1/2020 | Mills |
| 2020/0026141 | A1 | 1/2020 | Brown et al. |
| 2022/0021336 | A1 | 1/2022 | Younes |
| 2022/0023911 | A1 | 1/2022 | Gereige et al. |

FOREIGN PATENT DOCUMENTS

| | | |
|---|---|---|
| CN | 109211532 | 1/2019 |
| CN | 208563680 | 3/2019 |
| CN | 209544369 | 10/2019 |
| CN | 111006400 | 4/2020 |
| DE | 19809883 | 9/1999 |

OTHER PUBLICATIONS

Coustier et al., "Performance of copper-doped V2O5 xerogel in coin cell assembly." Journal of power sources 83.1-2, Oct. 1999, 9-14, 6 pages.

Tohidi et al., "Comparison Nanostructure Behaviour of Copper Species on the Silicamatrix Xerogels." International Journal of Engineering 24.2, Jul. 2011, 147-153, 7 pages.

Wang et al., "Selective synthesis of CuO/C nanocomposites and porous CuO based on polyacrylic acid hydrogel system as high-performance anode for lithium-ion batteries." Chemical Physics 518, Feb. 2019, 7 pages.

PCT International Search Report and Written Opinion in International Appln. No. PCT/US2022/014968, dated Jul. 13, 2022, 15 pages.

Abdallah et al., "Soiling loss rate measurements of photovoltaic modules in a hot and humid desert environment," Journal of Solar Energy Engineering, May 2020, Abstract only, 2 pages.

Chandler, "Getting more heat out of sunlight," Phys Org, Jul. 2019, 3 pages.

Chang et al., "Tuning Cu/Cu20 Interfaces for the Reduction of Carbon Dioxide to Methanol in Aqueous Solutions," Angew. Chem. Int. Ed., Oct. 2018, 130(47):15641-15645.

Chen et al., "Electrochemical Reduction of Carbon Dioxide to Ethane Using Nanostructured Cu2ODerived Copper Catalyst and Palladium (II) Chloride," J. Phys. Chem. C Nov. 2015, 119(48):26875-26882.

Chih et al., "Powering the future with liquid sunshine," Joule, Oct. 2018, 2(10):1925-1949.

Cho et al., "Confined cavity on a mass-producible wrinkle film promotes selective CO2 reduction," J. Mater. Chem. A, Jun. 2020, 8(29):14592-14599.

Cox, "The synthesis of Copper-based Aerogels and Xerogels via the Epoxide Addition Method Using Various Supports and Templates to Improve Surface are and Increase Efficiency in Preparation Techniques," Thesis for the degree of Master of Science, Texas Tech University, Aug. 2011, 63 pages.

Dinh et al., "CO2 electroreduction to ethylene via hydroxide-mediated copper catalysis at an abrupt interface," Science, May 2018, 360(6390):783-787.

Duan et al., "Amorphizing of Cu Nanoparticles toward Highly Efficient and Robust Electrocatalyst for CO2 Reduction to Liquid Fuels with High Faradaic Efficiencies," Adv. Mater., Feb. 2018, 30(14):1706194.

Endrodi et al., "Continuous-flow electroreduction of carbon dioxide," Prog. Energy Combust. Sci., Sep. 2017, 62:133-154.

explainthatstuff.com [online], ""Smart" windows (electrochromic glass)," available on or before Jul. 20, 2011, via Internet Archive: Wayback Machine URL <https://web.archive.org/web/20110720100002/https://www.explainthatstuff.com/electrochromic-windows.html>, retrieved on Oct. 8, 2020, URL <https://www.explainthatstuff.com/electrochromic-windows.html>, 7 pages.

Gao et al., "Improved CO2 Electroreduction Performance on Plasma-Activated Cu Catalysts via Electrolyte Design: Halide Effect," ACS Catal., Jun. 2017, 7(8):5112-5120.

Gao et al., "Plasma-Activated Copper Nanocube Catalysts for Efficient Carbon Dioxide Electroreduction to Hydrocarbons and Alcohols," ACS Nano, Apr. 2017, 11(5):4825-4831.

Hall et al., "Mesostructure-Induced Selectivity in CO2 Reduction Catalysis," J. Am. Chem. Soc., Nov. 2015, 137(47):14834-14837.

Han et al., "CO2 reduction selective for C≥2 products on polycrystalline copper with N-substituted pyridinium additives," ACS Cent. Sci., Jul. 2017, 3(8):853-859.

Handoko et al., "Mechanistic Insights into the Selective Electroreduction of Carbon Dioxide to Ethylene on Cu2O-Derived Copper Catalysts," J. Phys. Chem. C, Sep. 2016, 120(36):20058-20067.

Husain et al., "A review of transparent solar photovoltaic technologies," Renewable and Sustainable Energy Reviews, 2018, 94:779-791, 13 pages.

Jung et al., "Electrochemical Fragmentation of Cu2O Nanoparticles Enhancing Selective C-C Coupling from CO2 Reduction Reaction," J. Am. Chem. Soc., Jan. 2019, 141(11):4624-4633.

Keskin et al., "The Effects of Ethanol and Propanol Additions into Unleaded Gasoline on Exhaust and Noise Emissions of a Spark Ignition Engine," Energy Source Part A, Oct. 2011, 33(23):2194-2205.

Kim et al., "Copper nanoparticle ensembles for selective electroreduction of CO2 to C2—C3 products," Proc. Nat. Acad. Sci., Sep. 2017, 114(40):10560-10565.

Kim et al., "Cu/Cu20 interconnected porous aerogel catalyst for highly productive electrosynthesis of ethanol from CO2," Adv. Func. Mat., May 2021, 31(32):2102142.

Kim et al., "Insights into an autonomously formed oxygen-evacuated Cu2O electrode for the selective production of C2H4 from CO2," Phys. Chem. Chem. Phys., 2015, 17:824-830.

Kim et al., "Ternary hybrid aerogels of gC3N4/α-Fe2O3 on a 3D graphene network: An efficient and recyclable Z-schene photocatalyst," ChemPlusChem, Dec. 2019, 85(1):169-175.

Kim et al., "Z-scheme Photocatalytic CO2 Conversion on Three-Dimensional BiVO4/Carbon-Coated Cu2O Nanowire Arrays under Visible Light," ACS Catal., Apr. 2018, 8(5):4170-4177.

Kuhl et al., "New insights into the electrochemical reduction of carbon dioxide on metallic copper surfaces," Energy Environ. Sci., Feb. 2012, 5:7050-7059.

Lee et al., "Electrocatalytic Production of C3—C4 Compounds by Conversion of CO2 on a Chloride-Induced Bi-Phasic Cu2O—Cu Catalyst," Angew. Chem. Int. Ed., Oct. 2015, 127(49):14914-14918.

Lee et al., "Mixed Copper States in Anodized Cu Electrocatalyst for Stable and Selective Ethylene Production from CO2 Reduction," J. Am. Chem. Soc., Jun. 2018, 140(28):8681-8689.

Li et al., "Cooperative CO2-to-ethanol conversion via enriched intermediates at molecule-metal catalyst interfaces," Nat Catal., Dec. 2019, 3:75-82.

Li et al., "Electroreduction of carbon monoxide to liquid fuel on oxide-derived nanocrystalline copper," Nature, Apr. 2014, 508:504-507.

Li et al., "Recent advances in the nanoengineering of electrocatalysts for CO2 reduction," Nanoscale, Feb. 2018, 14:6235-6260.

Liang et al., "Copper-on-nitride enhances the stable electrosynthesis of multi-carbon products from CO2," Nat. Commun., Sep. 2018, 9:3828.

Ling et al., "Versatile Three-Dimensional Porous Cu@Cu2O Aerogel Networks as Electrocatalysts and Mimicking Peroxidases," Angew. Chem. Int. Ed., Apr. 2018, 130(23):6935-6940.

Liu et al., "Highly Active, Durable Ultrathin MoTe2 Layers for the Electroreduction of CO2 to CH4," Small, Mar. 2018, 19:1704049.

(56) References Cited

OTHER PUBLICATIONS

Lum et al., "Evidence for product-specific active sites on oxide-derived Cu catalysts for electrochemical CO2 reduction," Nat. Catal., Dec. 2018, 2:86-93.
Lum et al., "Optimizing C-C Coupling on Oxide-Derived Copper Catalysts for Electrochemical CO2 Reduction," J. Phys. Chem. C, Jun. 2017, 121(26):14191-14203.
Lum et al., "Stability of Residual Oxides in Oxide-Derived Copper Catalysts for Electrochemical CO2 Reduction Investigated with O-18 Labeling," Angew. Chem. Int. Ed., Nov. 2017, 57(2):551-554.
Lv et al., "A Highly Porous Copper Electrocatalyst for Carbon Dioxide Reduction," Adv. Mater., Oct. 2018, 30(49):1803111.
Ma et al., "Controllable Hydrocarbon Formation from the Electrochemical Reduction of CO2 over Cu Nanowire Arrays," Angew. Chem. Int. Ed, Apr. 2016, 55(23):6680-6684.
Mistry et al., "Highly selective plasma-activated copper catalysts for carbon dioxide reduction to ethylene," Nat. Commun., Jun. 2016, 7:12123.
Morales-Guio et al., "Improved CO2 reduction activity towards C2+ alcohols on a tandem gold on copper electrocatalyst," Nat. Catal., Oct. 2018, 1:764-771.
Ogura et al., "Catalytic reduction of CO2 to ethylene by electrolysis at a three-phase interface," J. Electrochem. Soc., Jul. 2003, 150(9):D163-D168.
Peterson et al., "How copper catalyzes the electroreduction of carbon dioxide into hydrocarbon fuels," Energy Environ. Sci., Jul. 2010, 3(9):1311-1315.
Qiao et al., "A review of catalysts for the electroreduction of carbon dioxide to produce lowcarbon fuels," Chem. Soc. Rev., Nov. 2013, 43(2):631-675.
Rahaman et al., "Electrochemical Reduction of CO2 into Multicarbon Alcohols on Activated Cu Mesh Catalysts: An Identical Location (IL) Study," ACS Catal., Oct. 2017, 7(11):7946-7956.
Ramos et al., "Hybrid photovoltaic-thermal solar systems for combined heating, cooling and power provision in the urban environment," Energy Conversion and Management, 2017, 150:838-850, 13 pages.
Ren et al., "Selective Electrochemical Reduction of Carbon Dioxide to Ethylene and Ethanol on Copper (I) Oxide Catalysts," ACS Catal., Mar. 2015, 5(5):2814-2821.
Ren et al., "Tuning the Selectivity of Carbon Dioxide Electroreduction toward Ethanol on Oxide-Derived CuxZn Catalysts," ACS Catal., Nov. 2016, 6(12):8239-8247.
Roberts et al., "High Selectivity for Ethylene from Carbon Dioxide Reduction over Copper Nanocube Electrocatalysts," Angew. Chem. Int. Ed., Feb. 2015, 127(17):5268-5271.
Scholten et al., "Plasma-Modified Dendritic Cu Catalyst for CO2 Electroreduction," ACS Catal., Apr. 2019, 9(6):5496-5502.
Sen et al., "Electrochemical Reduction of CO2 at Copper Nanofoams," ACS Catal., Aug. 2014, 4(9):3091-3095.
Siegfried et al., "Elucidating the effect of additives on the growth and stability of Cu2O surfaces via shape transformation of pre-grown crystals," J. Am. Chem. Soc., Jul. 2006, 128(32):10356-10357.
Sohn et al., "Anomalous Oxidation Resistance of "Core-Only" Copper Nanoparticles Electrochemically Grown on Gold Nanoislands Prefunctionalized by 1,4-phenylene Diisocyanide," Electrochem. Solid. St., Feb. 2012, 15(4):K35-K39.
solarnovus.com [online], "Desert Sand + Gravity: The secret to more efficient concentrated solar power," Jan. 2016, retrieved in Oct. 12, 2020, retrieved from URL <https://www.solarnovus.com/desert-sand-gravity-the-secret-tomore-efficient-concentrated-solar-power_N9619.html> , 5 pages.
Spurgeon et al., "A comparative technoeconomic analysis of pathways for commercial electrochemical CO2 reduction to liquid products," Energy Environ. Sci., Apr. 2018, 11(6):1536-1551.
Su et al., "Hierarchically porous Cu/Zn bimetallic catalysts for highly selective CO2 electroreduction to liquid C2 products," Appl. Catal. B-Environ., Jul. 2020, 269:118800.
Tohidi et al., "Characterization of sol-gel derived CuO/SiO2 nanostructure on temperature," Int. J. Ind. Chem., Sep. 2014, 5(3-4):63-68.
Vasileff et al., "Surface and Interface Engineering in Copper-Based Bimetallic Materials for Selective CO2 Electroreduction," Chem, Aug. 2018, 4(8):1809-1831.
Verdaguer-Casadevall et al., "Probing the Active Surface Sites for CO Reduction on Oxide-Derived Copper Electrocatalysts," J. Am. Chem. Soc., Jul. 2015, 137(31):9808-9811.
Wang et al., "Catalyst synthesis under CO2 electroreduction favours faceting and promotes renewable fuels electrosynthesis," Nat. Catal., Dec. 2019, 3:98-106.
Wu et al., "A metal-free electrocatalyst for carbon dioxide reduction to multi-carbon hydrocarbons and oxygenates," Nat. Commun., Dec. 2016, 7:13869.
Xiao et al., "Atomistic mechanisms underlying selectivities in C1 and C2 products from electromechanical reduction of CO on Cu(111)," J. Am. Chem. Soc., Dec. 2016, 139(1):130-136.
Xiao et al., "Cu metal embedded in oxidized matrix catalyst to promote CO2 activation and CO dimerization for electrochemical reduction of CO2," Proc. Nat. Acad. Sci., Jun. 2017, 114(26):6685-6688.
Zhao et al., "Harnessing Heat Beyond 200° C. from Unconcentrated Sunlight with Nonevacuated Transparent Aerogels," ACS Nano, Jun. 2019, 3(7):7508-7516, 9 pages.
Zhou et al., "Dopant-induced electron localization drives CO2 reduction to C2 hydrocarbons," Nat. Chem., Jul. 2018, 10:974-980.
Zhuang et al., "Copper nanocavities confine intermediates for efficient electrosynthesis of C3 alcohol fuels from carbon monoxide," Nat. Catal., Oct. 2018, 1:946-951.
Zhuang et al., "Steering post-C-C coupling selectivity enables high efficiency electroreduction of carbon dioxide to multi-carbon alcohols," Nat. Catal., Jun. 2018, 1: 21-428.

* cited by examiner

100

200

300

400

500

600

900

1500

1600

2300

2400

2500

2600

2900

POROUS COPPER/COPPER OXIDE XEROGEL CATALYST

CLAIM OF PRIORITY

This application claims priority to U.S. Provisional Application Ser. No. 63/144,778, filed on Feb. 2, 2021, the entire contents of which is hereby incorporated by reference.

TECHNICAL FIELD

The present disclosure is directed to the electrocatalytic synthesis of liquid fuels from carbon dioxide.

BACKGROUND

The removal of carbon dioxide ($CO_2$) from the atmosphere, followed by its sequestration is being explored. Most sequestration techniques isolate the $CO_2$, and then injected it into underground formations for storage. Utilization of the $CO_2$ for fuel generation would lower the cost of the $CO_2$ removal, as well as lower the total amount of $CO_2$ released in the atmosphere. The electrosynthesis of liquid fuels from $CO_2$ is a promising technology for performing this function.

Copper-based catalysts have a potential to synthesis $C_2$+ chemicals, providing high energy density fuels that may help in providing a sustainable carbon cycle. Accordingly, as a promising technology for carbon utilization, electrocatalytic $CO_2$ conversion is becoming a significant area for research.

However, the Faradaic efficiency (FE) for a $C_2$ product on a flat copper surface is limited to about 20% due to the high-energy barrier of the reaction and the competitive hydrogen evolution reaction (HER). Further, the partial current density ($J_{product}$) is still too small for commercial usage because of the low surface area and unfavorable reaction mechanics. To overcome this, nano-structuring of copper-based alloy and surface engineering is commonly used to improve reaction intermediate binding energy and local reaction environment control.

Among the various attempts to enhance $C_2$ product selectivity and productivity of $CO_2$ conversion electrocatalyst, oxide-derived Cu is of particular interest as it promotes CO binding and the following C—C coupling in the reaction step. Copper catalysts prepared from copper oxides could improve selectivity for $C_2$ production by residual oxygen or $Cu^+$ atoms and under-coordinated surface Cu atom. For instance, $Cu_2O$ formed by electrochemically deposition, $O_2$ plasma treatment, thermal annealing, and chemical synthesis achieved faradaic efficiency (FE) for $C_2H_4$ ($FE_{C2H4}$) of up to about 60%. However, partial current density (J), which correlates with actual production rate, is too small. Further, no reported catalysts have FE and J for ethanol production above 35% and 20 mA/cm$^2$ in H-cell reactor.

SUMMARY

An embodiment described in examples herein provides an electrocatalytic catalyst. The electrocatalytic catalyst includes a xerogel formed from copper oxide and copper.

Another embodiment described herein provides a method for making an electrocatalytic catalyst. The method includes dissolving a copper salt in a water solution, adjusting the pH of the water solution to be basic, adding a reducing agent to the water solution, and separating a product powder from the water solution, wherein the product powder is a copper/copper oxide xerogel.

DETAILED DESCRIPTION

Experimental and theoretical reports suggest catalysts with partial oxidation states of Cu, for example, having both $Cu^+$ and $Cu^0$ regions, may make effective electrocatalysts. From computational studies, $CO_2$ activation and CO dimerization energy barrier will be significantly lower on the interface between $Cu^+$ and $Cu^0$ region while impeding the $C_1$ product pathway. Therefore, catalyst design for maximizing $Cu^+$ and $Cu^0$ interfaces may be important for efficient and selective $C_2$ production.

In examples provided herein, a copper/copper oxide ($Cu/Cu_2O$) xerogel is synthesized by wet-chemistry. As used herein, a xerogel is a solid formed from a gel by drying with unhindered shrinkage. Xerogels generally have high porosity (15-50%) and high surface area (150-900 m2/g), as well as a very small pore size (1-10 nm). To form an electrode for the $CO_2$ conversion, the synthesized xerogel was drop-casted on carbon paper. The $Cu/Cu_2O$ xerogel exhibited $FE_{C2H4}$ and $FE_{EtOH}$ up to 40%, one of the highest values for EtOH among catalyst tested.

Furthermore, the partial current density of the production of ethanol ($J_{EtOH}$) reached 31.2 mA/cm2, which is which is higher than any value noted in tests of comparative copper electrocatalysts or in previous research on copper electrocatalysts. When the $Cu/Cu_2O$ xerogel was used in a flow cell reactor as a gas diffusion electrode (GDE), the $J_{EtOH}$ was increased to 72.1 mA/cm2. A high selectivity to $C_2$ product was provided by a high interface region between $Cu^0$ and $Cu^+$ interfaces, which facilitated $CO_2$ activation and C—C dimerization.

It is believed that the morphology of the porous xerogel structure, which has a high surface area and confined spaces, confines the reaction intermediates in close proximity to the active interface regions, contributing to the high productivity. The increase of ethanol productivity over other catalyst may be ascribed to densely located $Cu^0$—$Cu^+$ interfaces, which facilitate $CO_2$ activation and C—C dimerization. As these are the reactions, which control the production of $C_{2+}$ chemicals over hydrogen and $C_1$ chemicals, the production of ethanol is higher than the competing chemicals.

Figure 1:
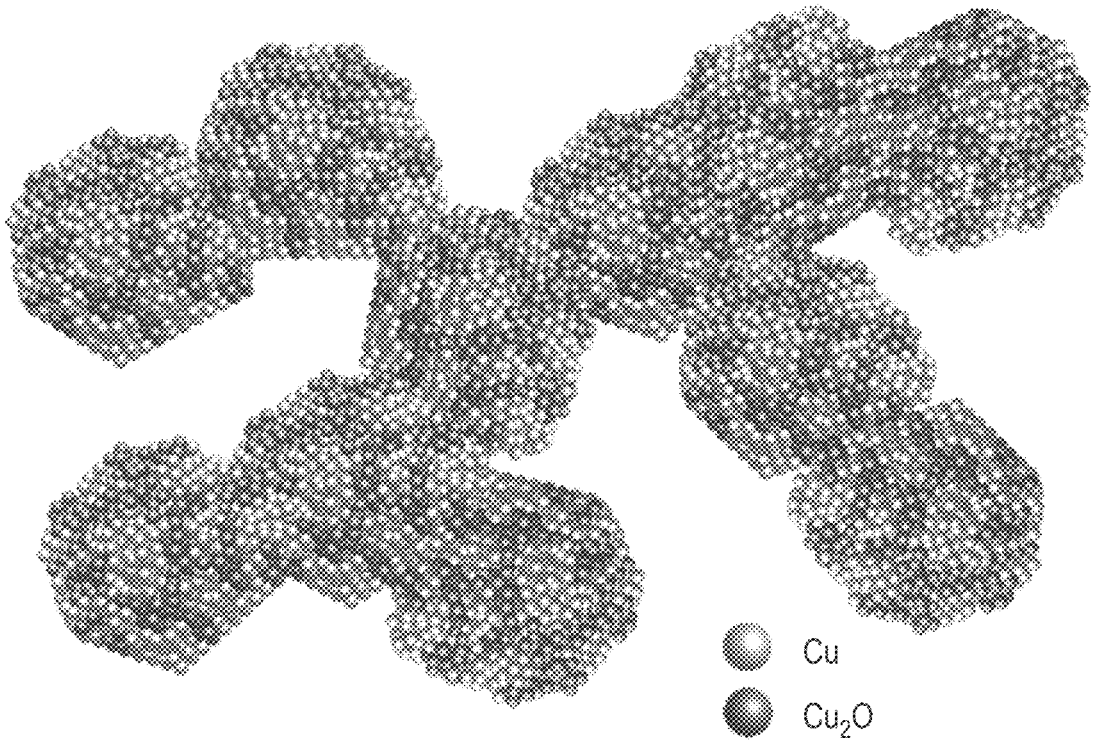
FIG. 1 is a drawing showing the morphology of a copper/copper oxide xerogel.

FIG. 1 is a drawing 100 showing the morphology of a copper/copper oxide xerogel. $Cu/Cu_2O$ xerogel was made by a wet chemical synthesis method using a $CuCl_2$ precursor, NaOH, and controlled amounts of $NaBH_4$ as a reducing agent to form the $Cu^0$. The product was collected by centrifugation with water and ethanol and dried at room temperature, forming the xerogel structure.

Figure 2:
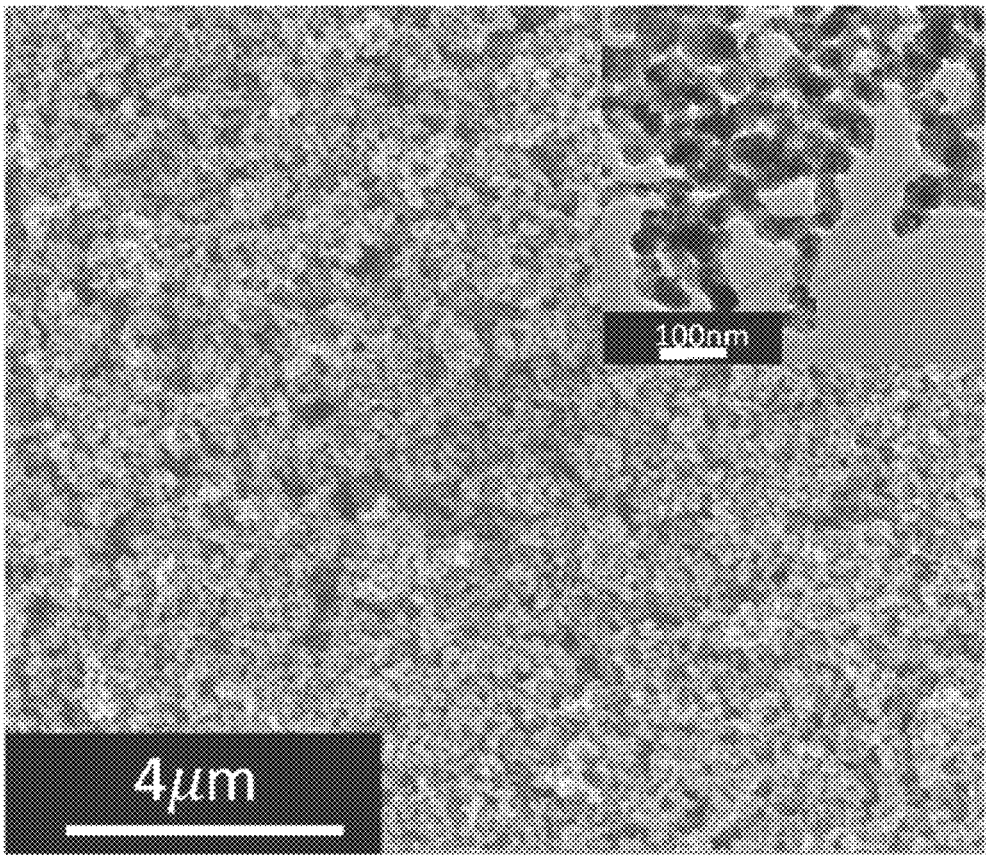
FIG. 2 is a transmission electron micrograph image of the copper/copper oxide xerogel.

FIG. 2 is a transmission electron micrograph image 200 of the copper/copper oxide xerogel. The $Cu/Cu_2O$ xerogel network is composed of densely interconnected nanoparticles with a size under about 50 nm.

Figure 3:
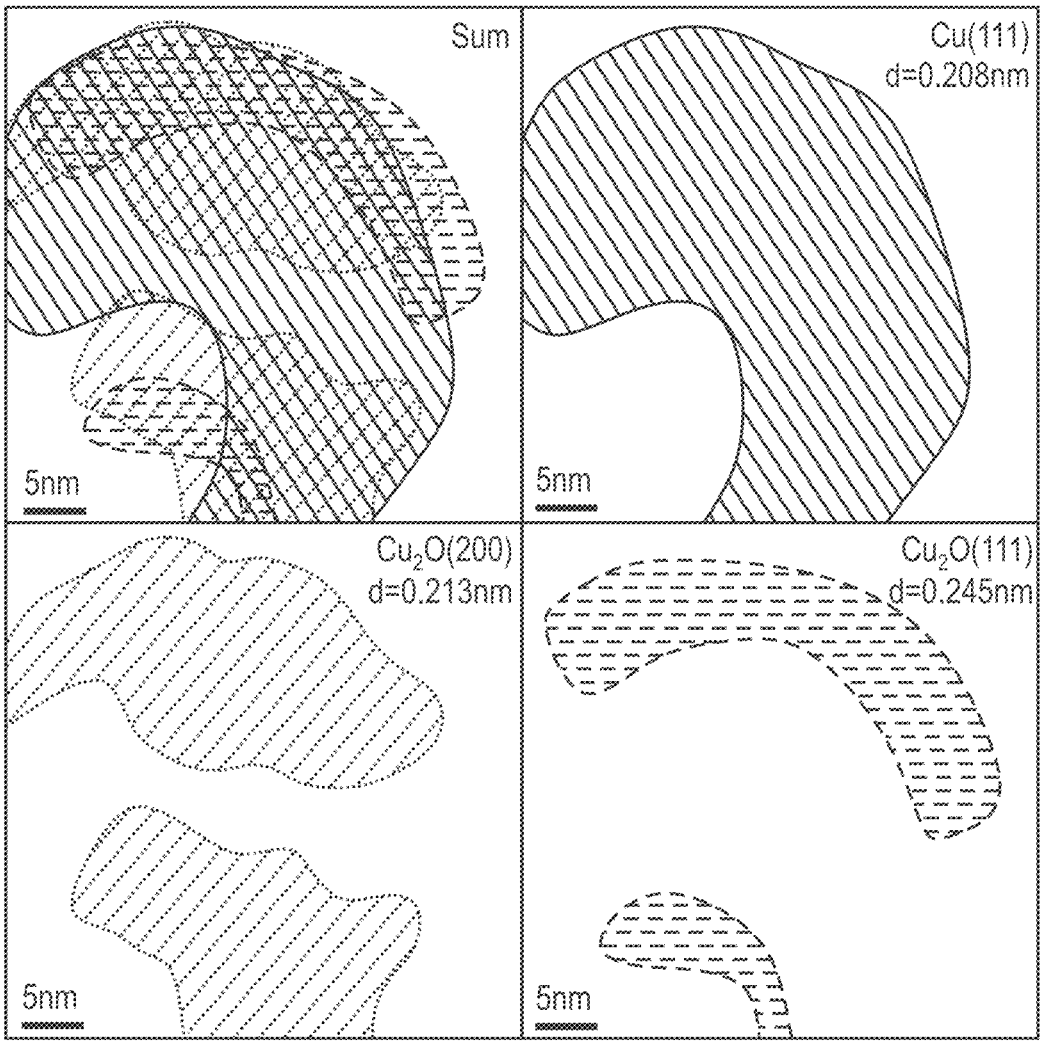
FIG. 3 is an inverse FFT image of the transmission electron micrograph showing the composition of the xerogel.

FIG. 3 is an inverse FFT image 300 of the transmission electron micrograph showing the composition of the xerogel. In order to identify and visualize the uniform distribution of Cu and $Cu_2O$ on the surface, high-resolution transmission electron microscopy (HR-TEM) with inverse-fast Fourier transformation (inverse-FFT) mapping was conducted. As shown, a nanoparticle in the $Cu/Cu_2O$ xerogel shows a mixed crystal structure of 0.179 nm, 0.209 nm, and 0.245 nm interlayer spacing of the lattice fringes, which corresponds to Cu (200), (111) and $Cu_2O$ (111) domains, respectively. The domains have a size of about 10 nm. The nanoparticles and domains are randomly distributed on the overall surface of the $Cu/Cu_2O$ xerogel. Thus, the inverse FFT image 300 shows a high density of $Cu^0$—$Cu^+$ interfaces, which are the active sites for the production of $C_2$ from the conversion of $CO_2$.

Figure 4:
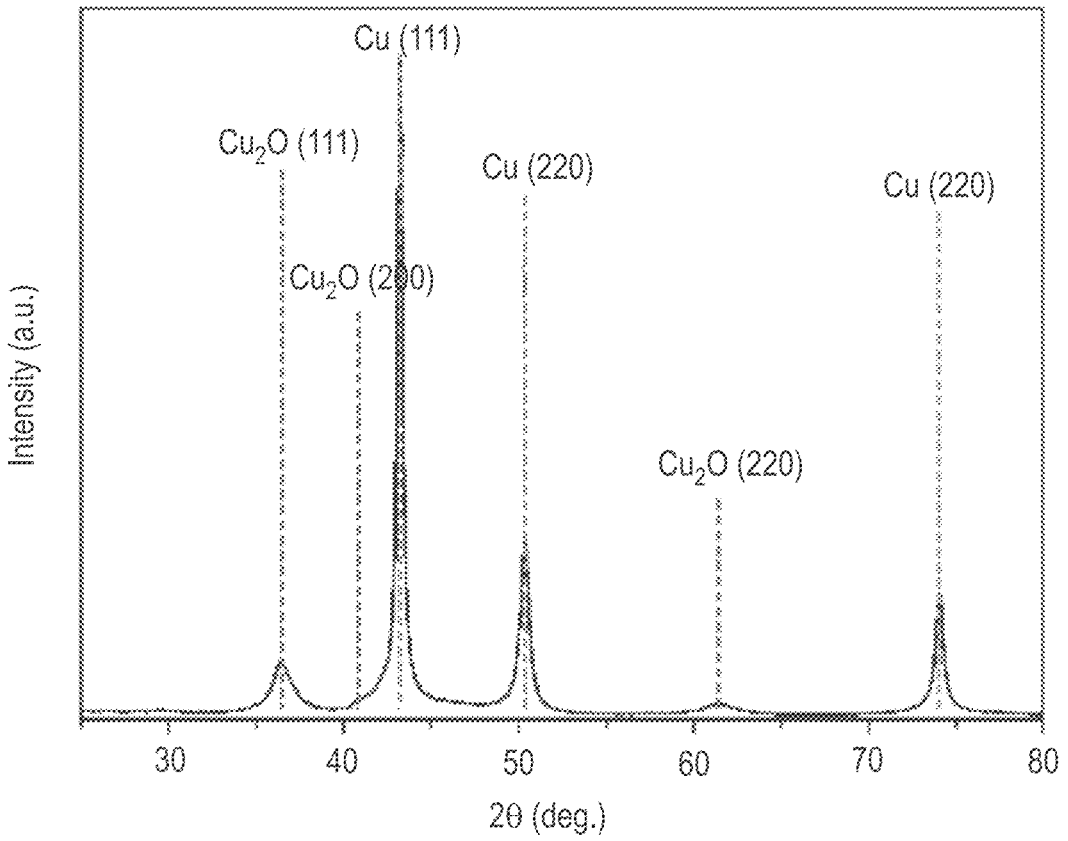
FIG. 4 is a plot of the XRD analysis of the copper/copper oxide xerogel.

FIG. 4 is a plot 400 of the XRD analysis of the copper/copper oxide xerogel. The X-ray diffraction (XRD) spectrum also confirms crystalline formation of (111) dominant Cu and (111), (200) dominant $Cu_2O$ in $Cu/Cu_2O$ xerogel. This is in agreement with the interlayer spacing and plane observed in the HR-TEM image in FIG. 3.

Figure 5:
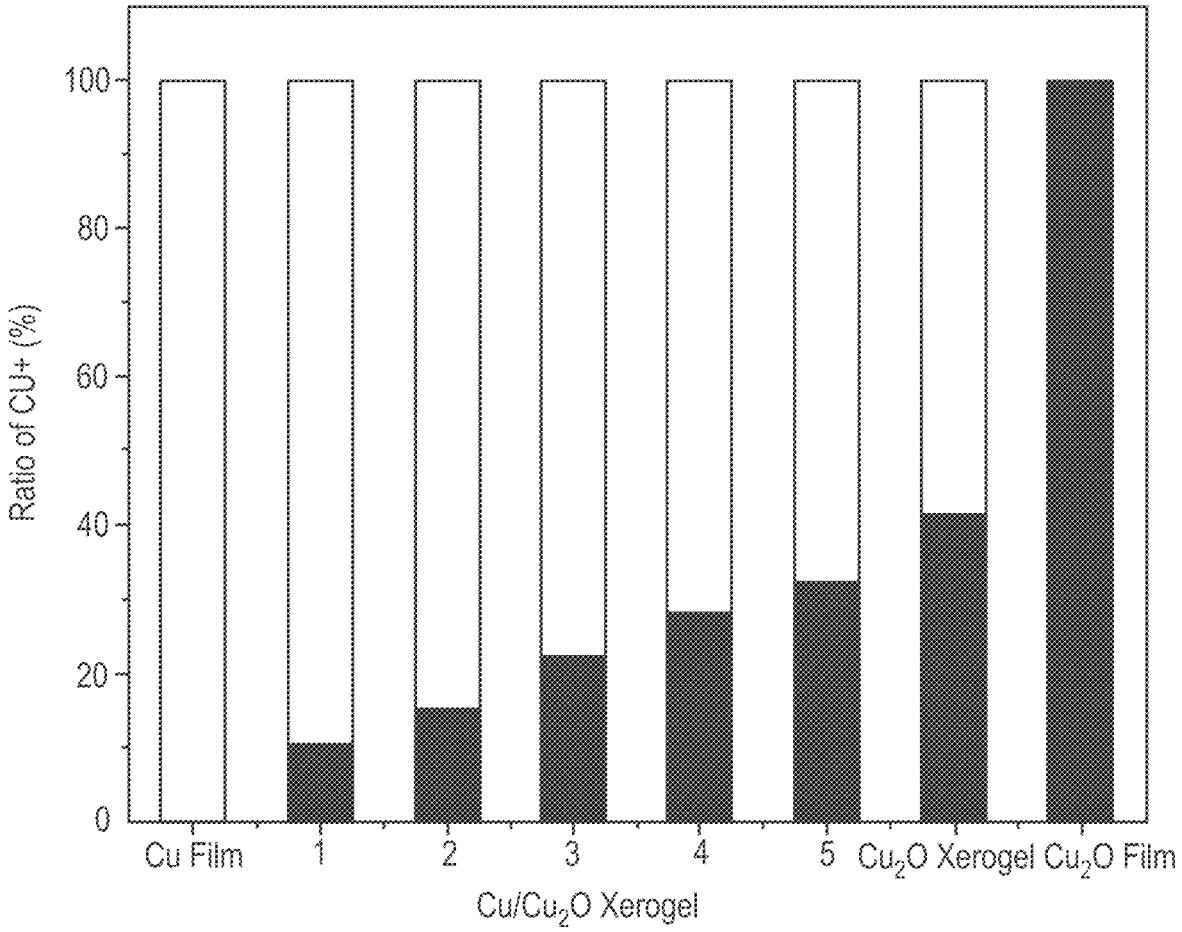
FIG. 5 is a plot of the X-ray photoelectron spectroscopy (XPS) Auger copper LMM peak of the copper/copper oxide xerogel for a number of different compositions.

FIG. 5 is a plot 500 of the X-ray photoelectron spectroscopy (XPS) Auger copper LMM peak of the copper/copper oxide xerogel for a number of different compositions. The compositions labeled as 1 to 5 correspond to samples 1 to 5, herein. The ratio indicated along the y-axis is the ratio between $Cu^+$ and Cu. The Cu 2p and Auger Cu LMM peaks in the XPS further verify the surface chemical state, which has mixture of 22.3% $Cu^+$ and dominant $Cu^0$ species located at 916 eV and 919.9 eV.

Figure 6:
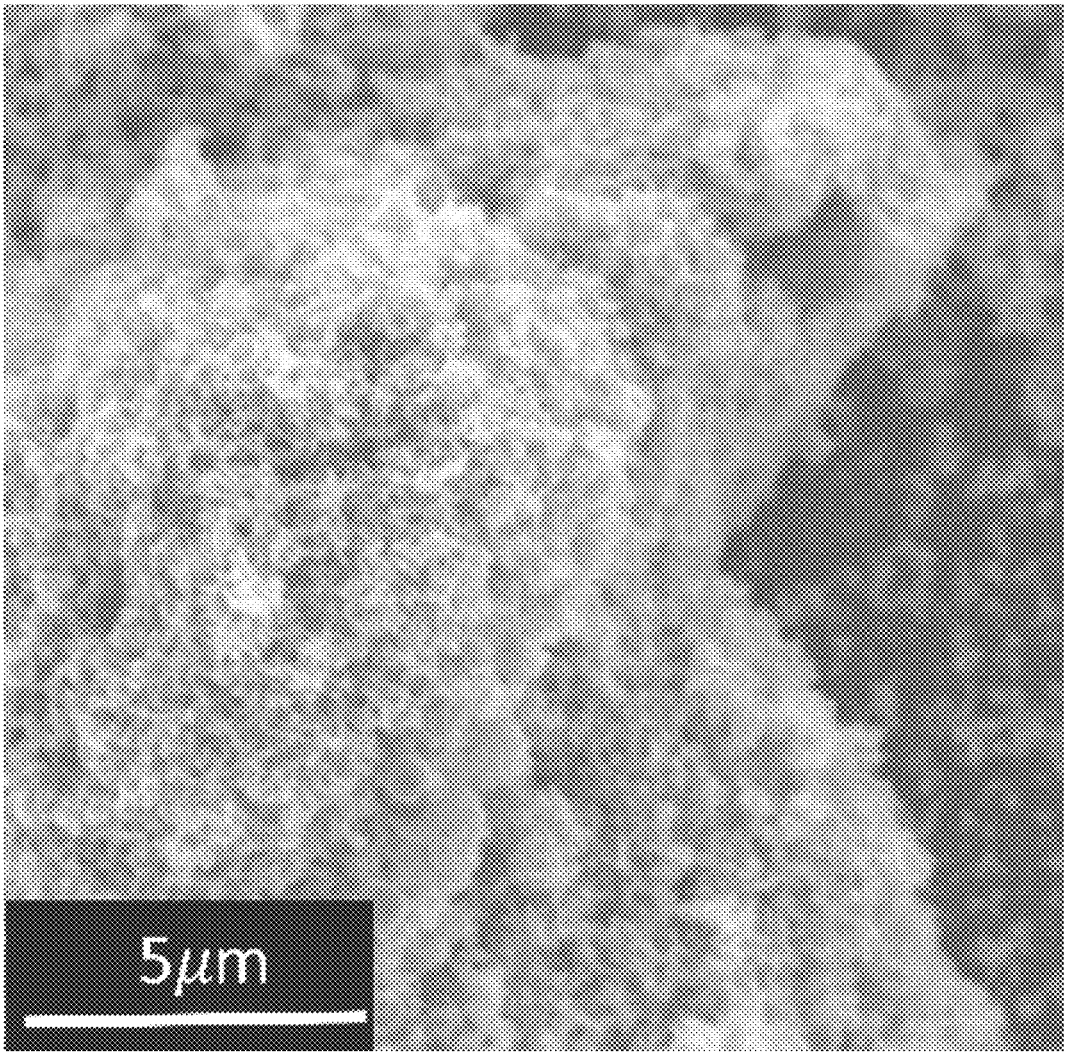
FIG. 6 is a scanning electron micrograph image of the copper/copper oxide xerogel.

FIG. 6 is a scanning electron micrograph image 600 of the copper/copper oxide xerogel. The scanning electron microscopy (SEM) image 600 shows the highly porous, 3-dimensional nanostructure of the $Cu/Cu_2O$ xerogel.

Figure 7A:
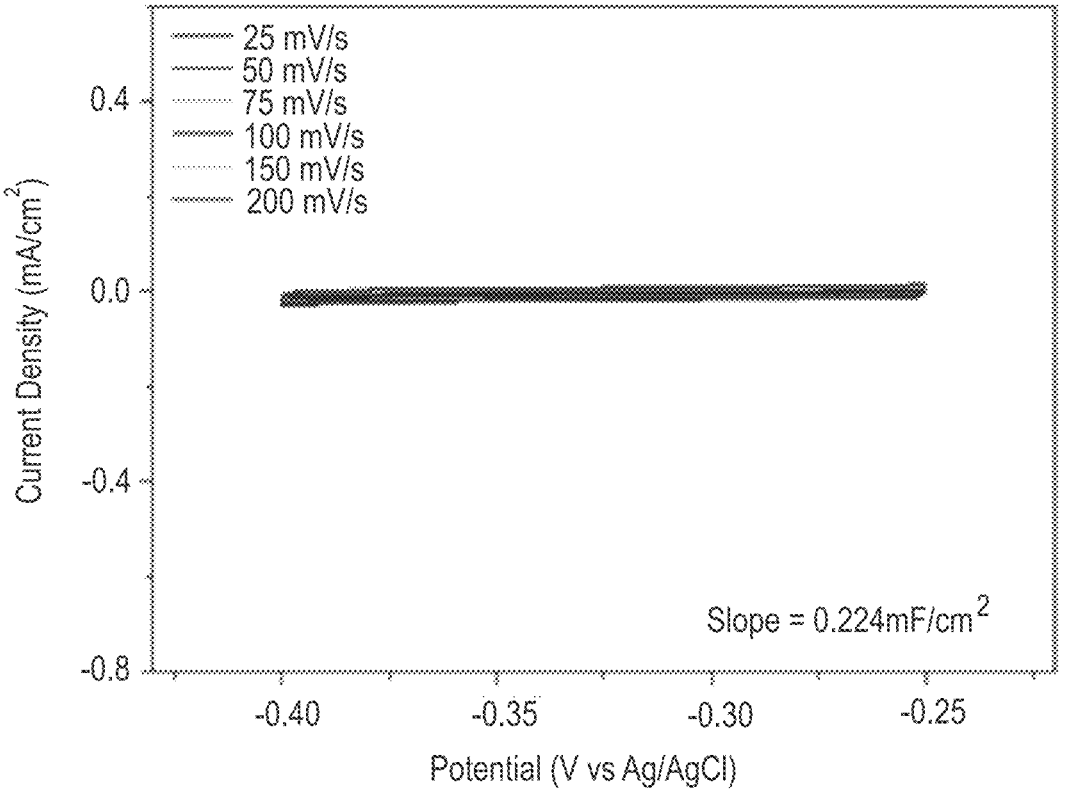
FIGS. 7A to 7D are cyclic voltammetry scans used for electrochemical surface area measurements of different copper surfaces.
Figure 7B:
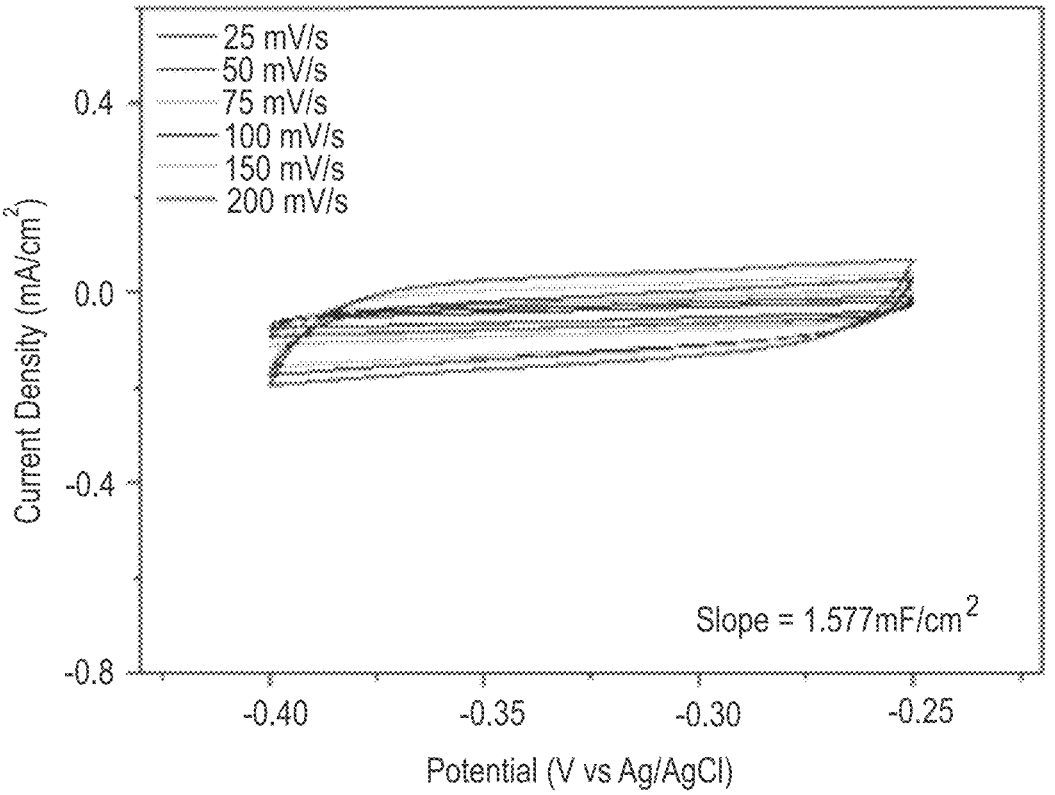
Figure 7C:
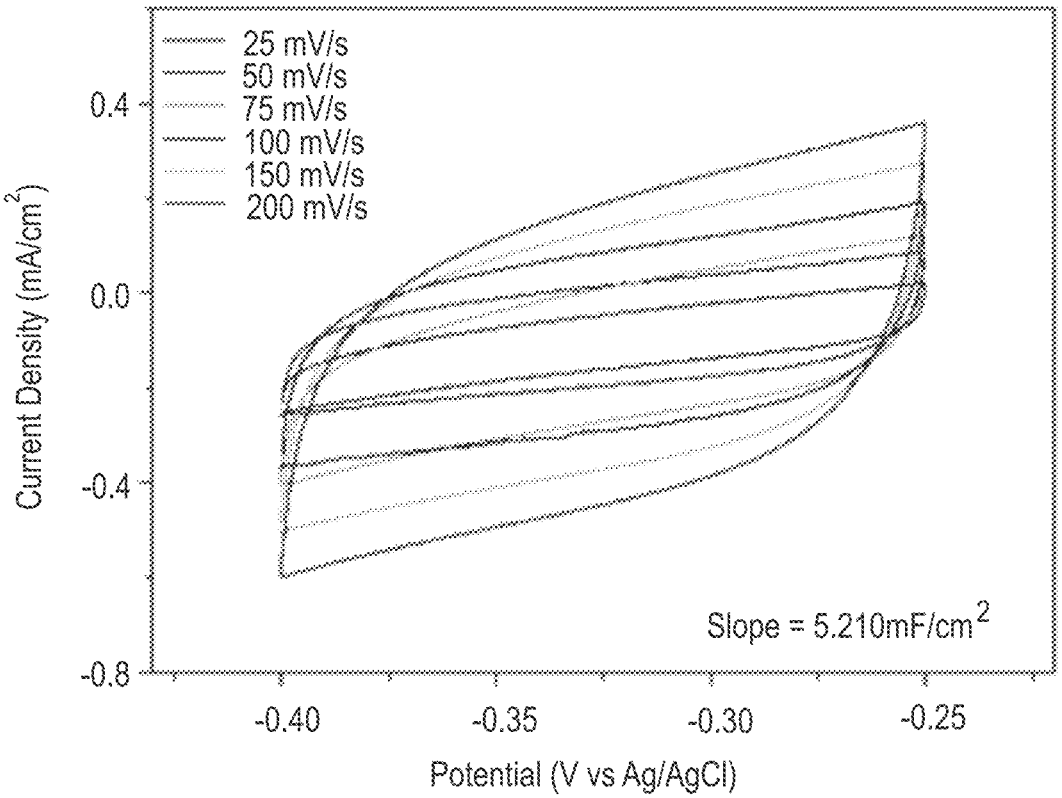
Figure 7D:
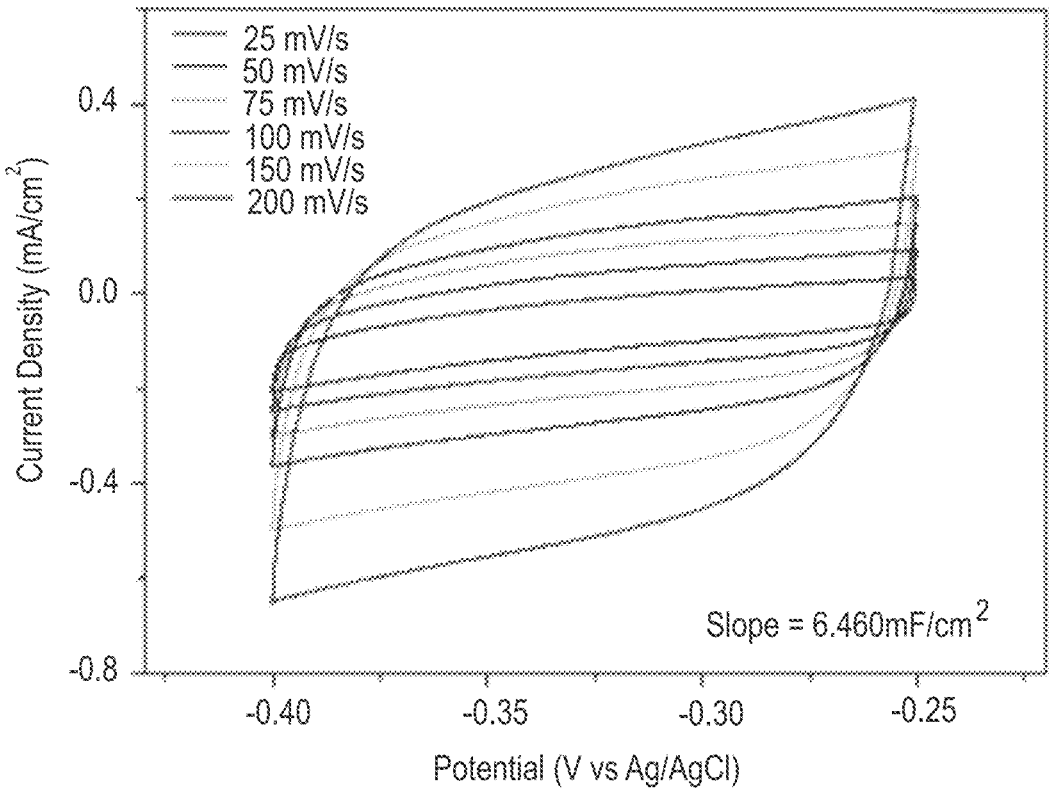
Figure 8A:
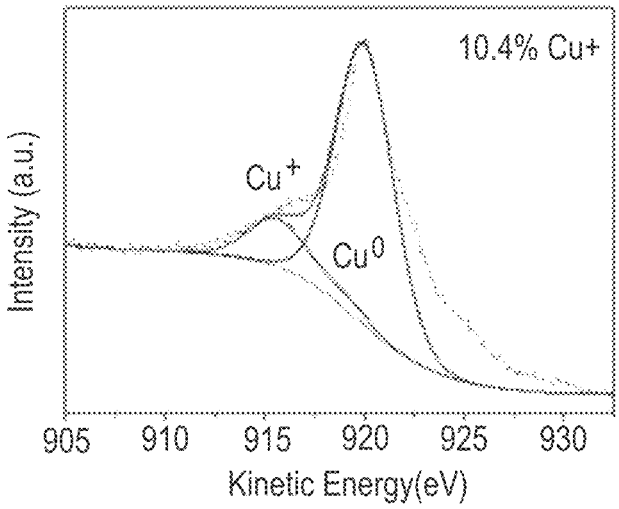
FIGS. 8A to 8F are XPS Auger copper LMM peaks of copper/copper oxide xerogels (samples 1 to 5, as described herein) at different concentrations of copper using a copper oxide xerogel (FIG. 8F) as a reference.
Figure 8B:
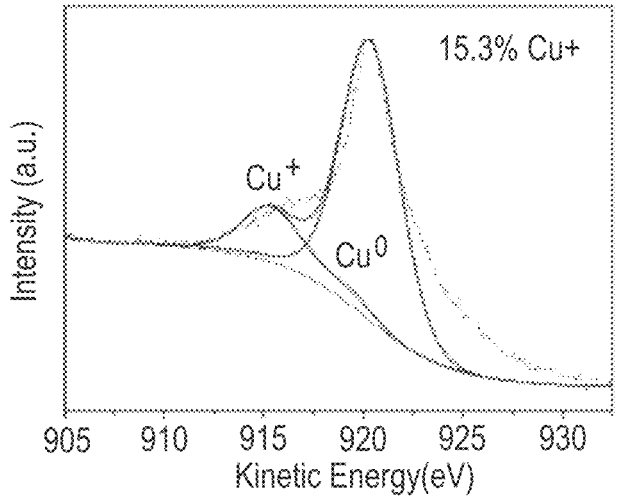
Figure 8C:
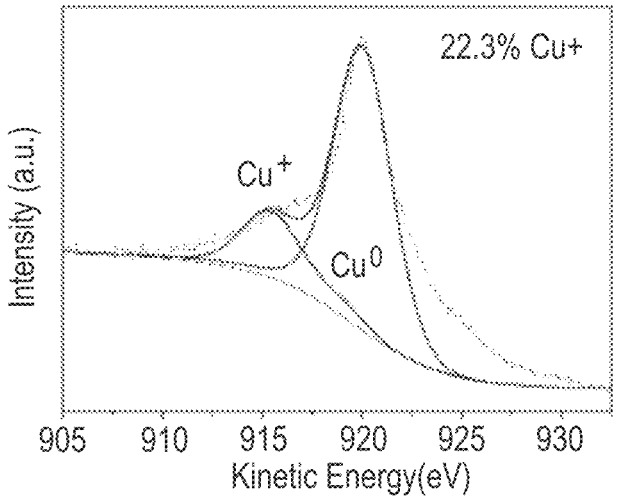
Figure 8D:
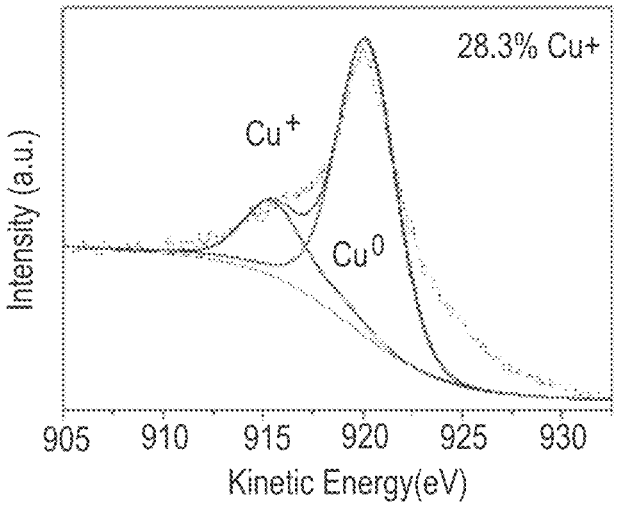
Figure 8E:
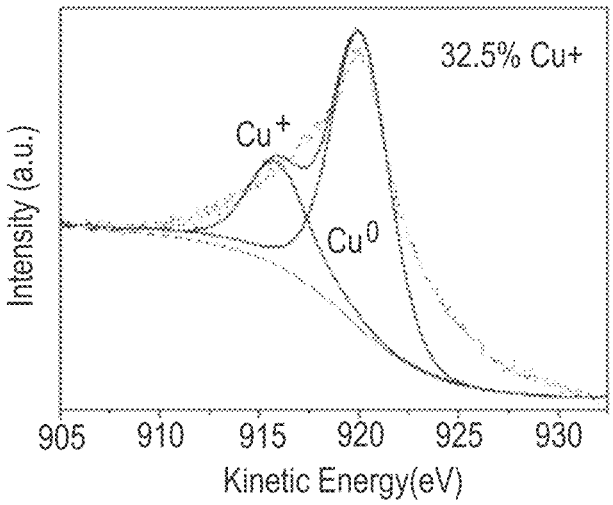
Figure 8F:
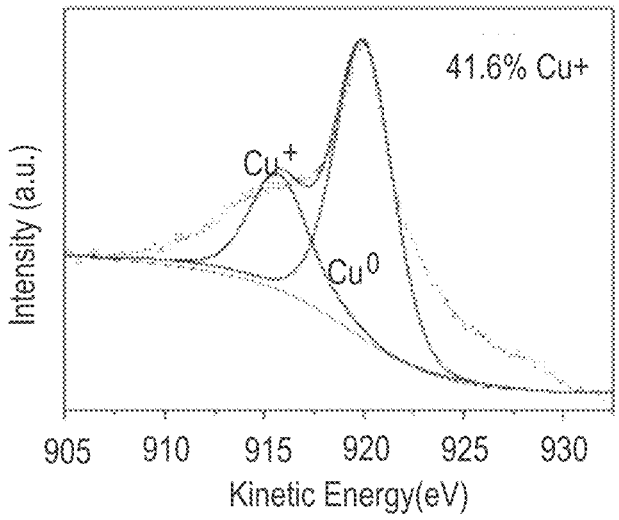

FIGS. 7A to 7D are cyclic voltammetry (CV) scans used for electrochemical surface area (ECSA) measurements of different copper surfaces. FIG. 7A is a CV scan of a planar Cu surface. FIG. 7B is a CV scan of a planar $Cu_2O$ surface. FIG. 7C is a CV scan of a $Cu_2O$ xerogel. FIG. 7D is a CV scan of a $Cu/Cu_2O$ xerogel (sample 3, as described herein). The measurements were performed between −0.4 and −0.25 V versus an Ag/AgCl (KCl saturated) electrode in a 0.1 molar KCl solution between 25 and 300 mV/s.

The corresponding capacitance (CdI) was determined by using cyclic voltammetry (CV) with a changing scan rate. The CdI of the $Cu/Cu_2O$ xerogel was measured as 5.21 mF/cm2, which is 28 times higher than that of planar Cu (0.224 mF/cm2). Accordingly, the high surface area and porous structure will form catalyst with efficient electrocatalytic $CO_2$ conversion performance.

FIGS. 8A to 8F are XPS Auger copper LMM peaks of copper/copper oxide xerogels (samples 1 to 5, as described herein) at different concentrations of copper using a copper oxide xerogel (FIG. 8F) as a reference. As shown in FIGS. 8A to 8E, the ratio of $Cu_2O$ to Cu can be controlled by changing the amount of reducing agent in the synthesis procedure, as noted with respect to the examples. As seen in these figures, the $Cu/Cu_2O$ xerogels (samples 1 to 5) in FIGS. 8A to 8E show mixed compositions of Cu and $Cu_2O$ with increasing portion of $Cu_2O$.

Figure 9:
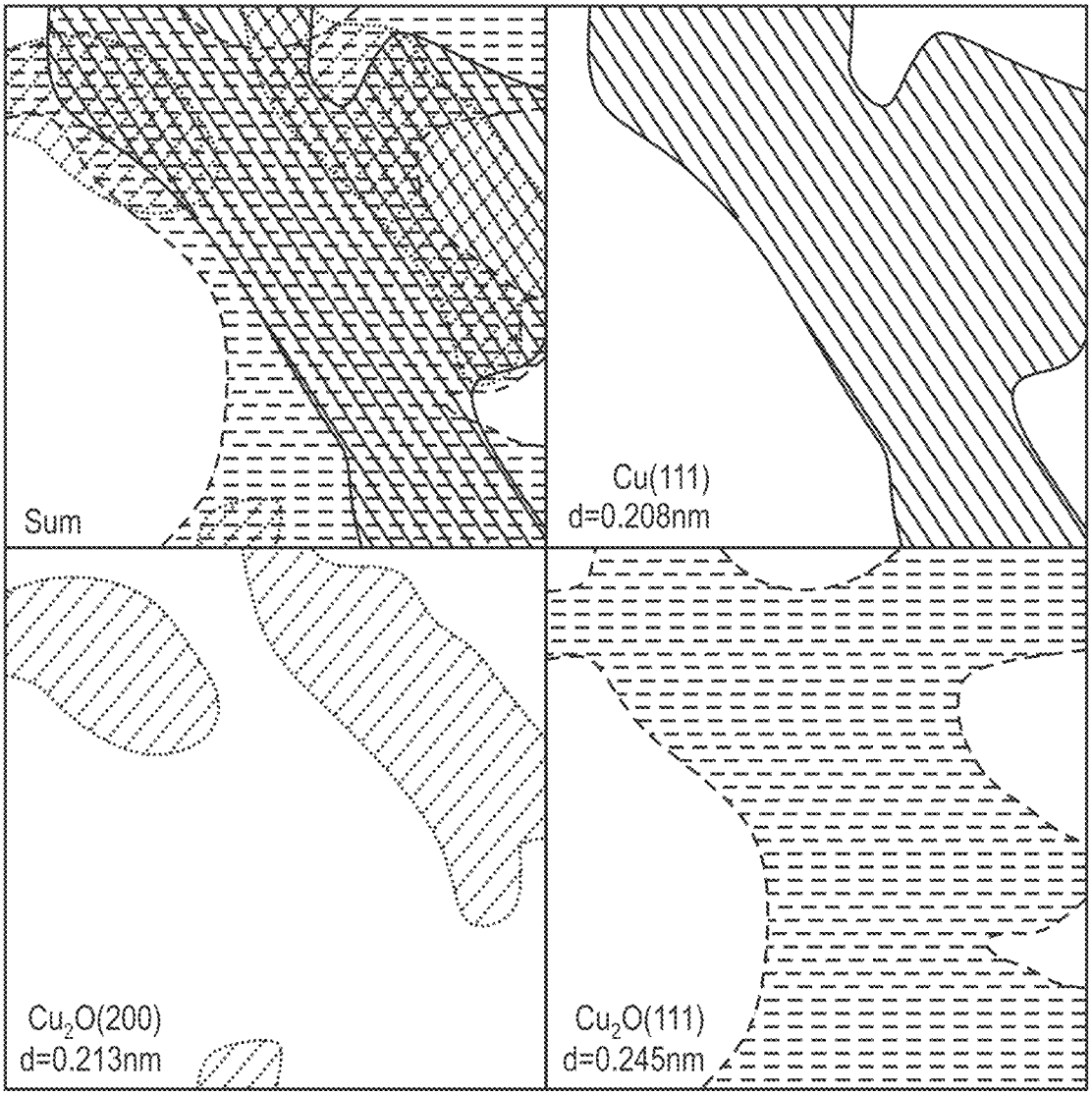
FIG. 9 is a HR-TEM inverse-FFT mapping images of copper oxide xerogel.

FIG. 9 are HR-TEM inverse-FFT mapping images 900 of copper oxide xerogel. With an excess amount of reducing agent, excess amount of $Cu_2O$ will fully covered by $Cu_2O$ over a Cu core. This is shown by the surface exhibiting a strong $Cu^+$ peak in the Auger LMM spectrum.

Figure 10A:
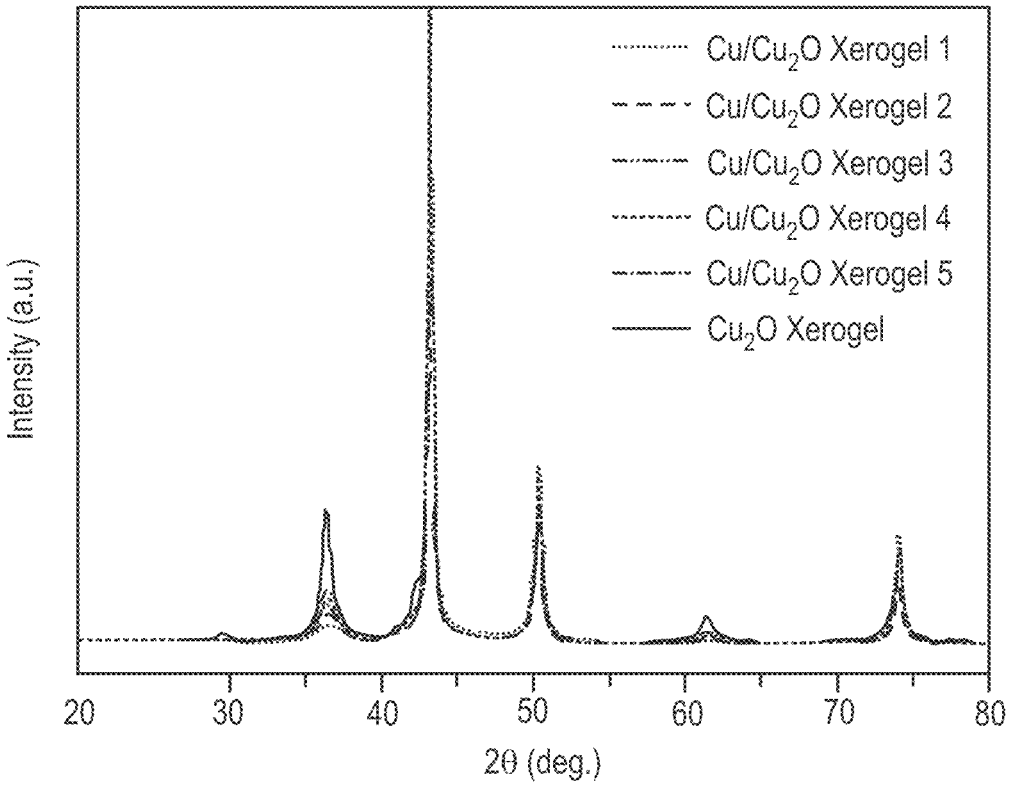
FIGS. 10A to 10C are XRD spectra of copper/copper oxide xerogel and copper oxide xerogel.
Figure 10B:
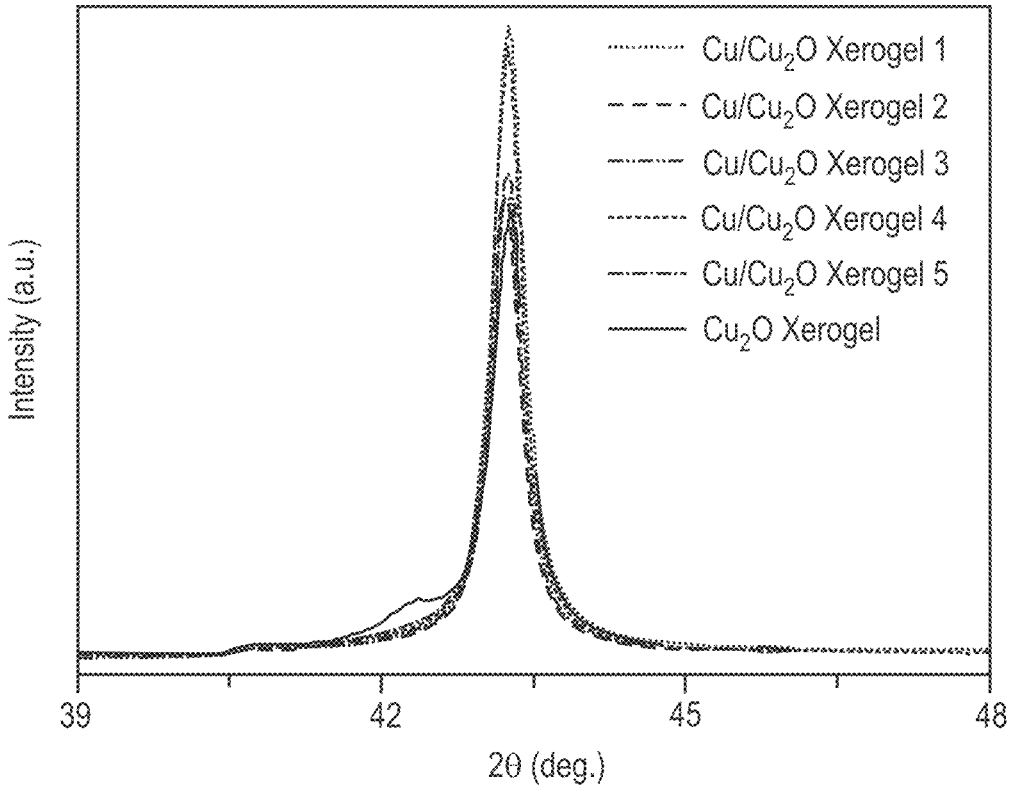
Figure 10C:
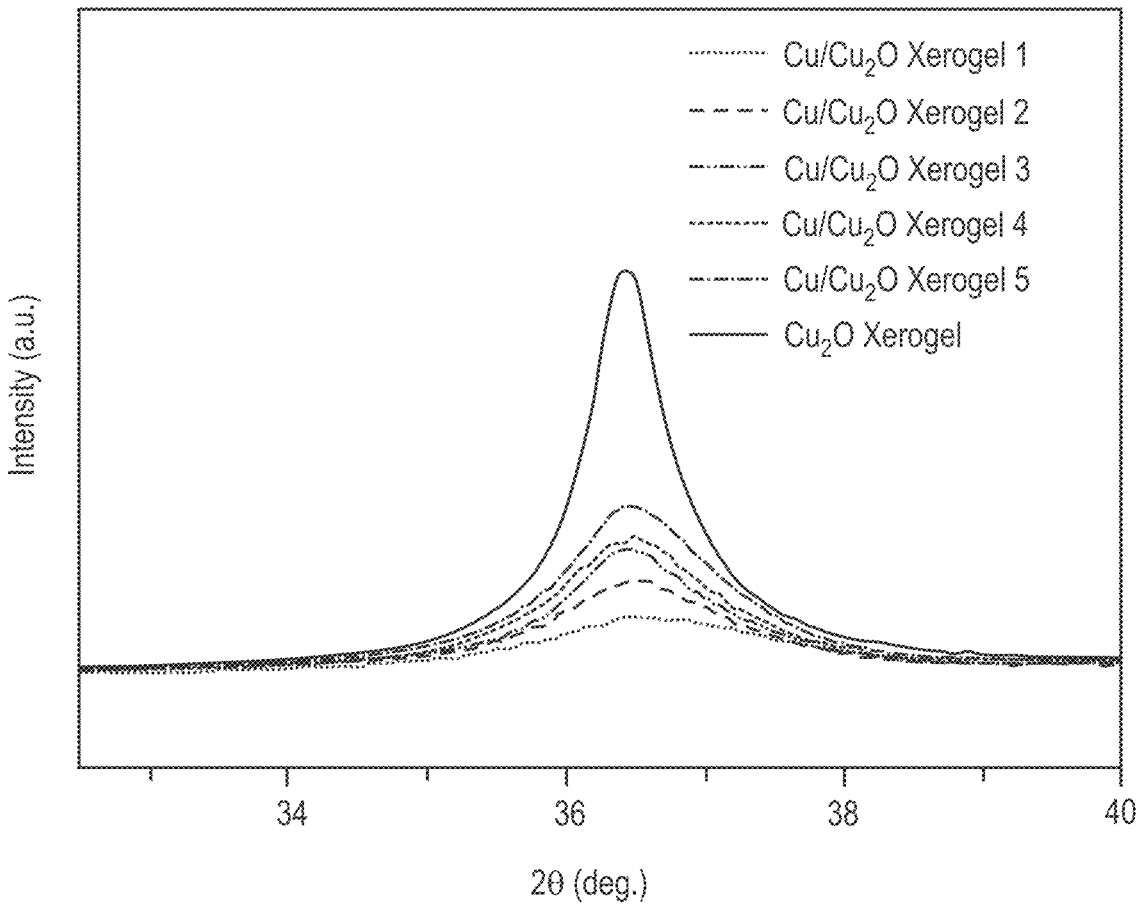

FIGS. 10A to 10C are XRD spectra of copper/copper oxide xerogel and copper oxide xerogel. Mean domain size was also investigated by using the values of the XRD peaks in the Scherrer equation. The results are shown in Table 1. Despite the $Cu_2O$ to Cu ratio changing in $Cu/Cu_2O$ xerogel samples 1 to 5 and $Cu_2O$ xerogel, the mean domain size of dominant $Cu_2O$ (111) and Cu (111) were maintained at about 5 nm and about 8 nm, respectively.

TABLE 1

| Mean Domain Size | | | |
|---|---|---|---|
| Mean domain size | $Cu_2O$ (111) (nm) | Cu (111) (nm) | Molar ratio of $Cu^+$ to Cu |
| $Cu_2O$ xerogel | 5.12 | 8.423 | 41.6 |
| $Cu/Cu_2O$ sample 5 | 5.04 | 8.506 | 32.5 |
| $Cu/Cu_2O$ sample 4 | 5.16 | 8.245 | 28.3 |
| $Cu/Cu_2O$ sample 3 | 5.65 | 8.135 | 22.3 |
| $Cu/Cu_2O$ sample 2 | 5.10 | 8.222 | 15.3 |
| $Cu/Cu_2O$ sample 1 | 5.58 | 8.102 | 10.4 |

Figure 11A:
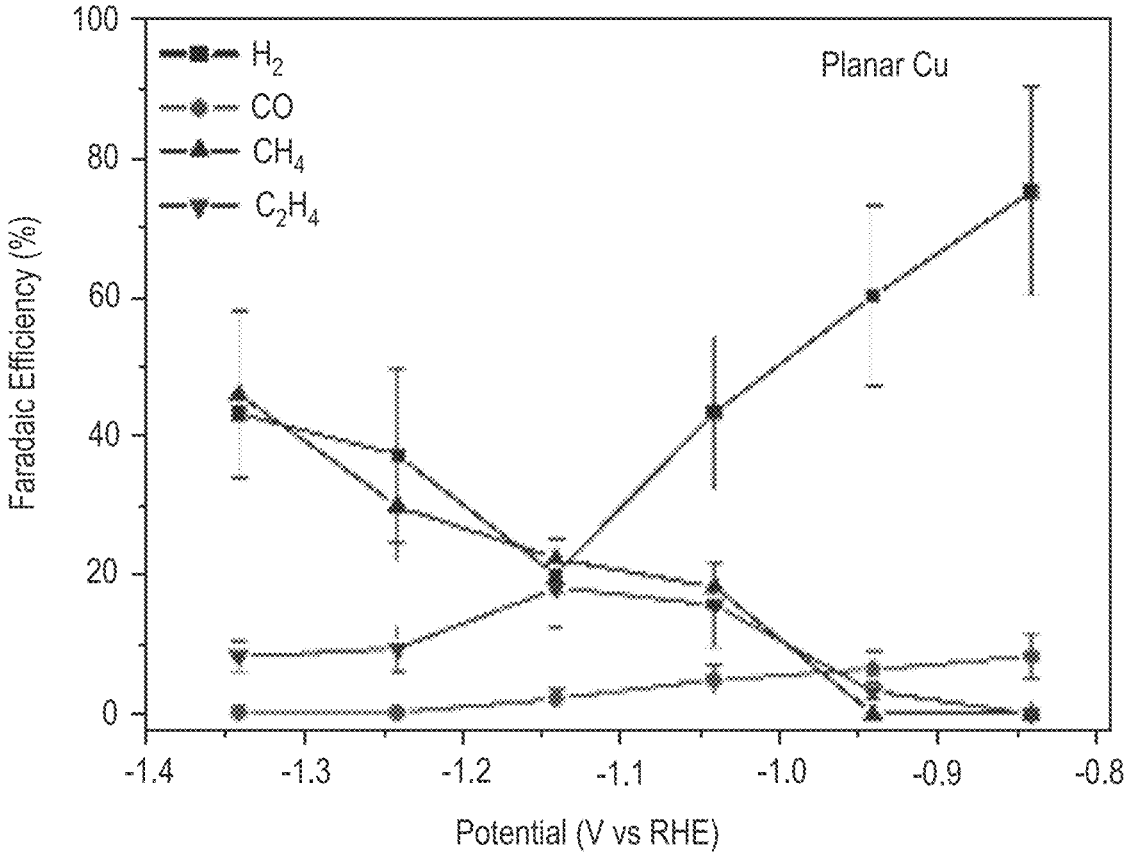
FIGS. 11A and 11B are plots of the $CO_2$ electroconversion performance of a planar copper surface catalyst.
Figure 11B:
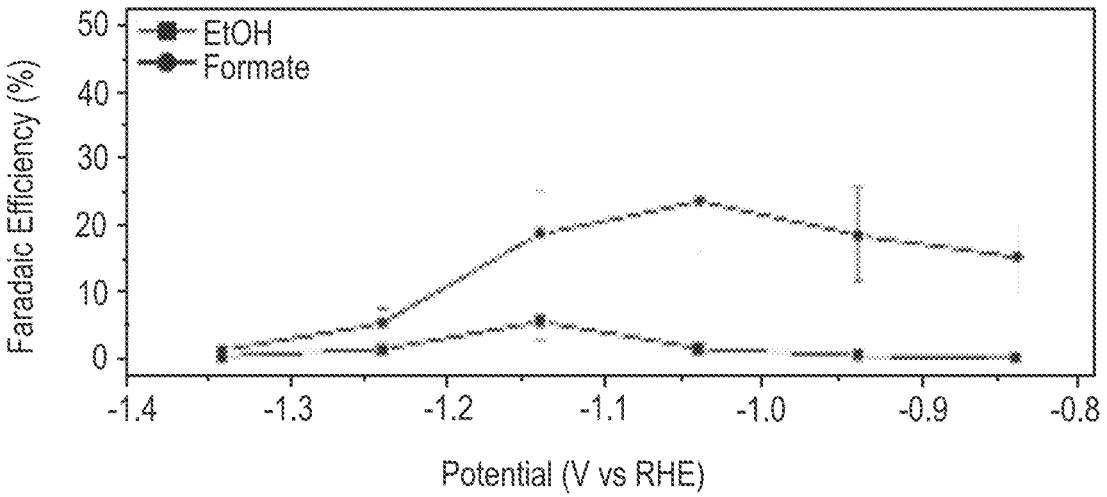
Figure 12A:
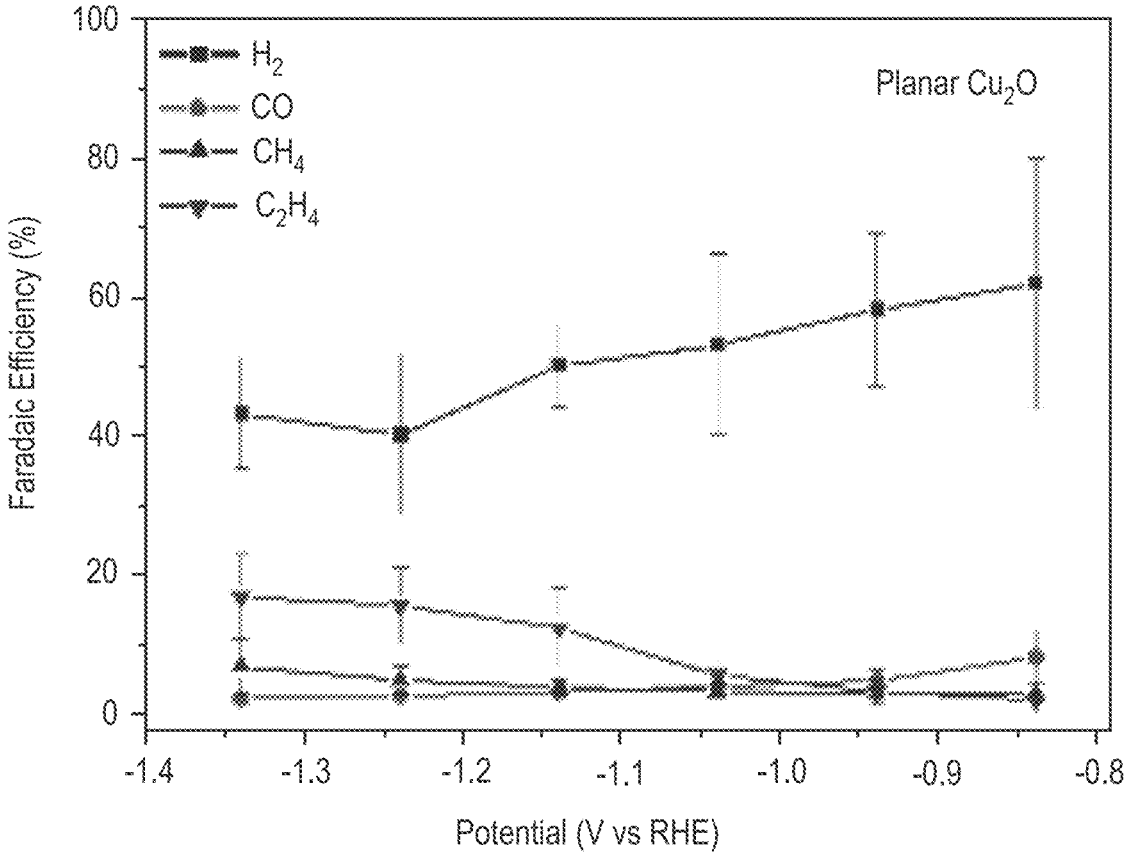
FIGS. 12A and 12B are plots of the $CO_2$ electroconversion performance of a planar copper oxide surface catalyst.
Figure 12B:
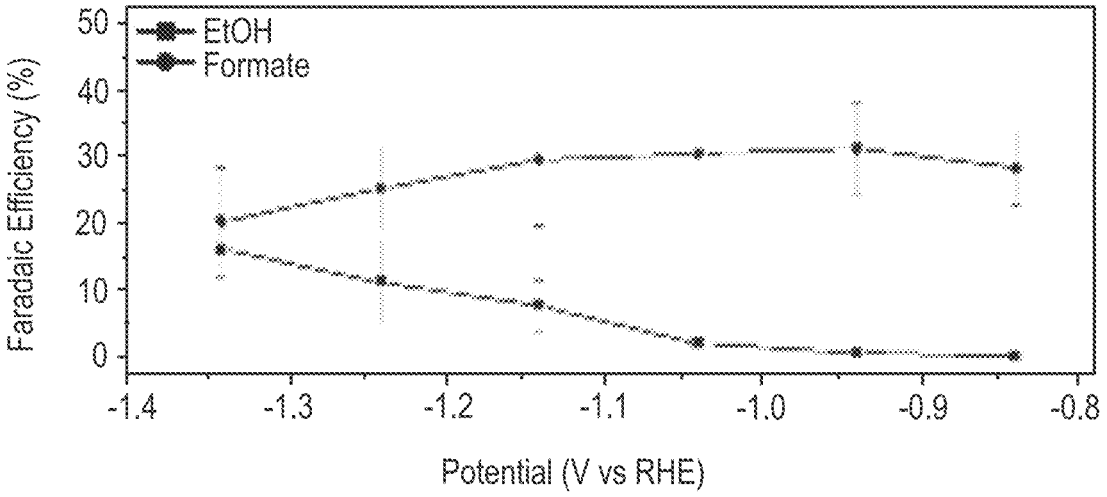
Figure 13A:
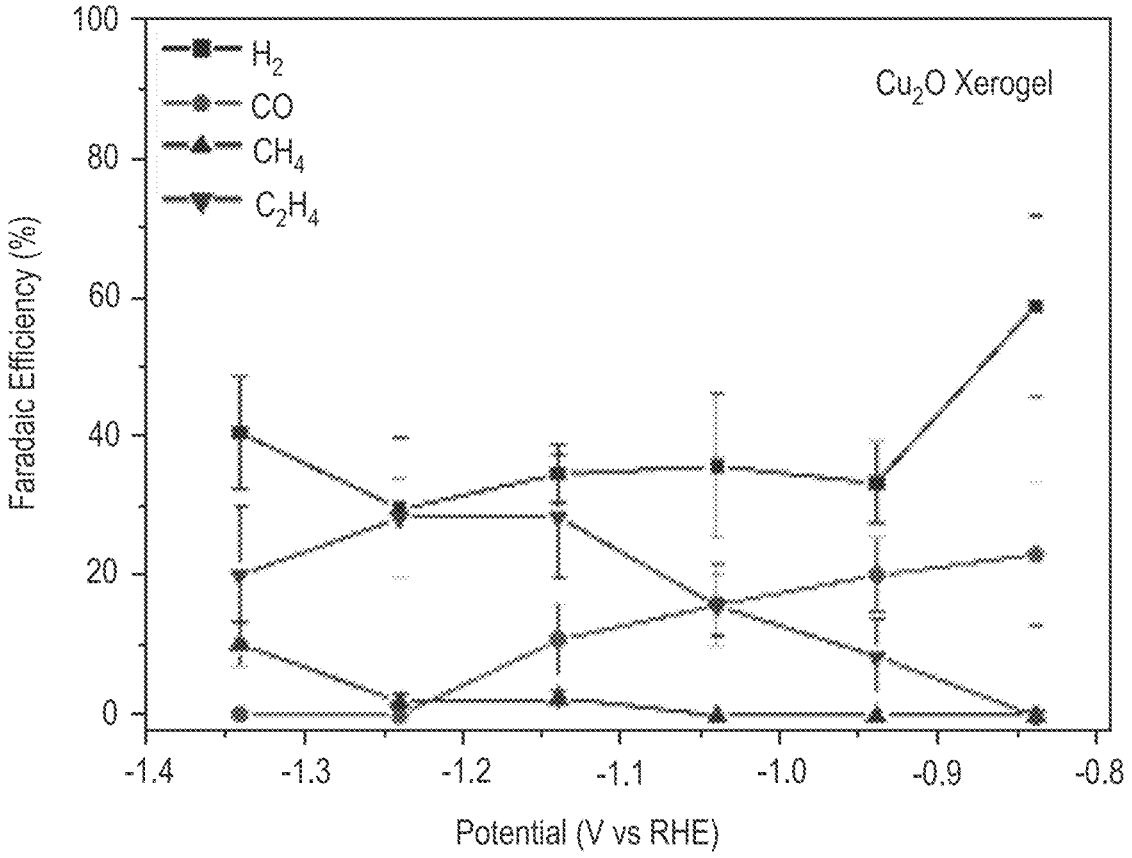
FIGS. 13A and 13B are plots of the $CO_2$ electroconversion performance of a copper oxide xerogel catalyst.
Figure 13B:
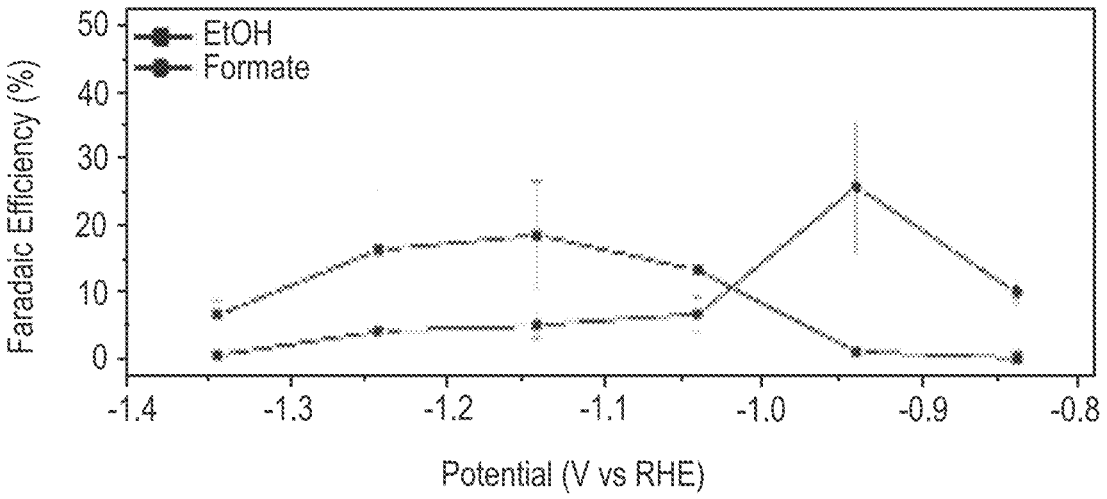
Figure 14A:
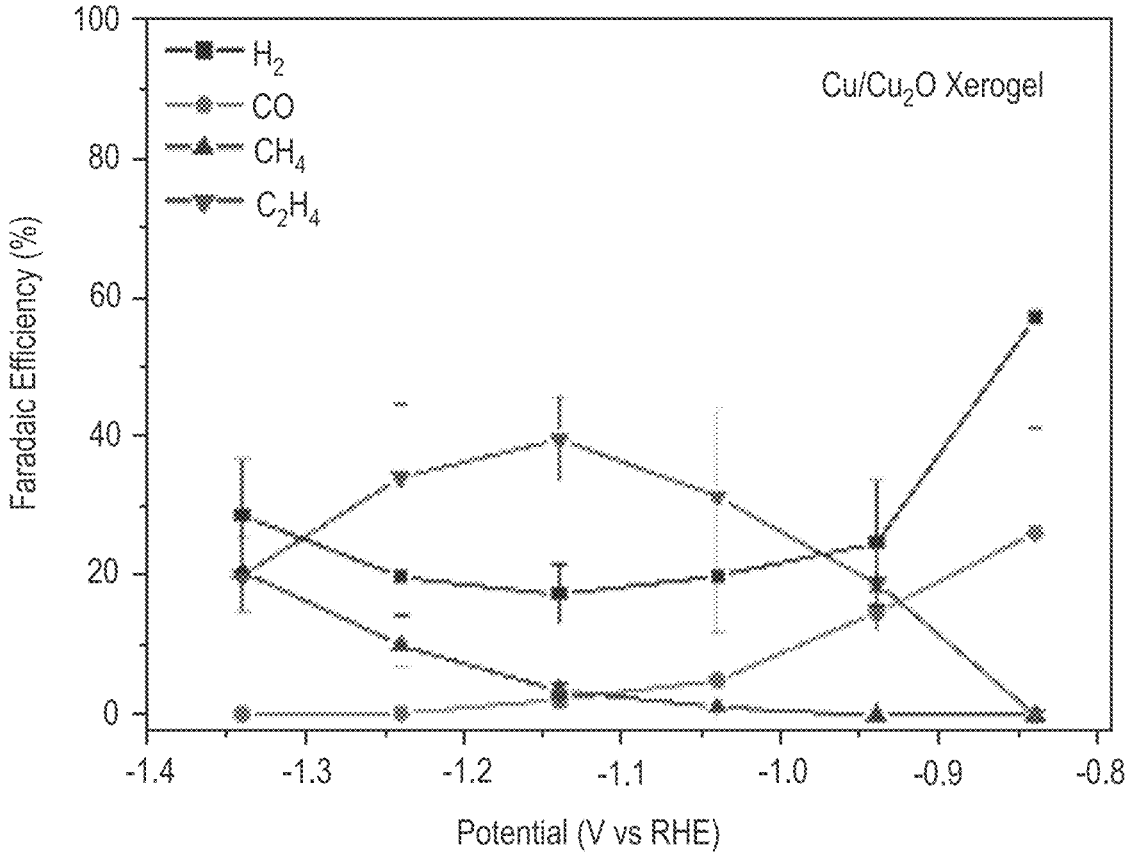
FIGS. 14A and 14B are plots of the $CO_2$ electroconversion performance of a copper/copper oxide xerogel catalyst.
Figure 14B:
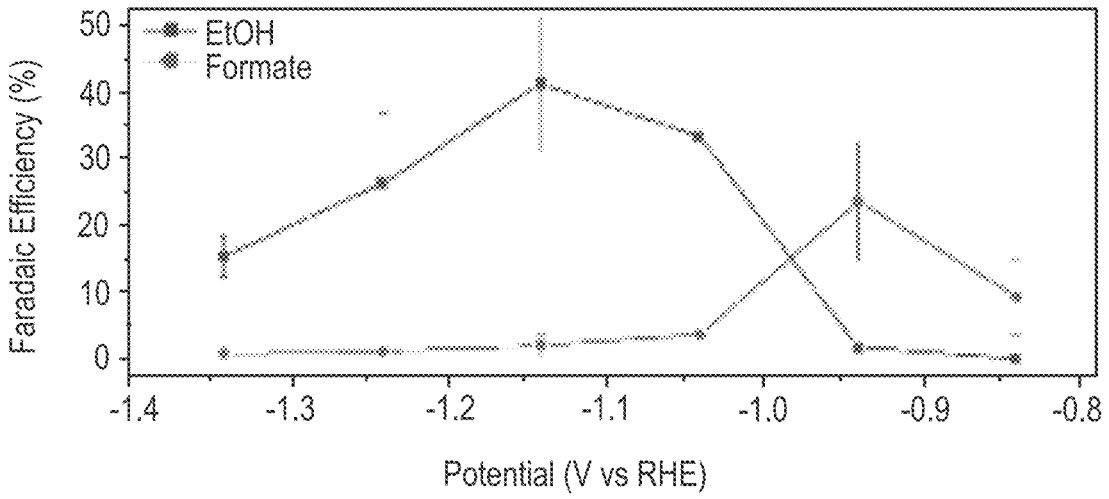

FIGS. 11A, 11B, 12A, 12B, 13A, 13B, 14A, and 14B show FE to $CO_2$ conversion products with applied potential between −0.84 and −1.34 V vs RHE for $Cu/Cu_2O$ xerogel (sample 3) and planar Cu, planar $Cu_2O$, $Cu_2O$ xerogel as a control sample. FIGS. 11A and 11B are plots of the $CO_2$ electroconversion performance of a planar copper surface catalyst. FIGS. 12A and 12B are plots of the $CO_2$ electroconversion performance of a planar copper oxide surface catalyst. FIGS. 13A and 13B are plots of the $CO_2$ electroconversion performance of a copper oxide xerogel catalyst. FIGS. 14A and 14B are plots of the $CO_2$ electroconversion performance of a copper/copper oxide xerogel catalyst.

The evaluation in FIGS. 11A, 11B, 12A, 12B, 13A, 13B, 14A, and 14B was performed by drop casting the $Cu/Cu_2O$ xerogel (sample 3) with a mixture of Nafion® in methanol solvent. The xerogel structures on the carbon paper electrode maintained the porous structure and the selectivity and productivity toward various products was analyzed under different applied potential with iR correction. An H-cell reactor was used with a $CO_2$-saturated 0.1 M KCl electrolyte for stable preservation of $Cu_2O$ phase during electrolysis and better suppression of the undesired HER.

The control samples, planar Cu and planar $Cu_2O$, are shown in FIGS. 11A, 11B, 12A, and 12B, respectively. Compared to the planar Cu, the planar $Cu_2O$ showed lower methane formation and higher $C_2$ product formation at potentials more negative than −1.04 V vs RHE, which is explained as an effect of oxide-derived copper.

The effect of the xerogel structure on $C_2$ product selectivity was observed in the $Cu_2O$ xerogel, shown in FIGS. 13A and 13B. The HER and $C_1$ product selectivity were significantly suppressed over the entire potential range with enhanced $C_2$ selectivity. The $CO_2$ reduction overpotential was also lower. These changes may be attributed to the confinement of the intermediates in proximity to the catalytically active sites and the change of local pH environment in the highly porous xerogel structure.

The $Cu/Cu_2O$ xerogel sample (using sample 3 as described with respect to Table 1), provided the results shown in FIGS. 14A and 14B. The $Cu/Cu_2O$ xerogel sample gave the highest $C_2$ production among the other catalysts, especially for the production of ethanol. The high count of $Cu^0$—$Cu^+$ interfaces on the highly porous xerogel structure substantially suppressed HER and $C_1$ production, and facilitated $CO_2$ activation and C—C dimerization. Accordingly, the highest FE for ethanol and ethylene reached 41.2% and 39.6% at −1.14 V vs RUE.

Figure 15:
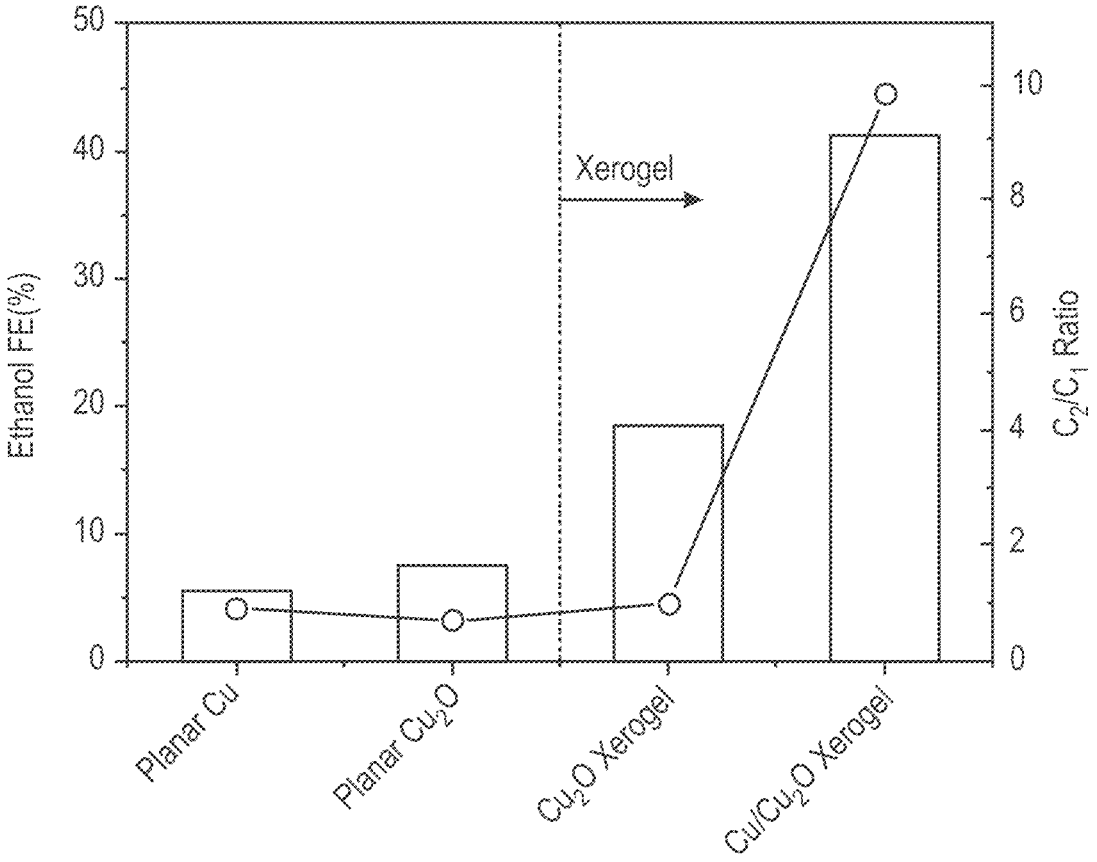
FIG. 15 is a plot comparing the Faraday efficiency of each of the catalysts for the production of ethanol at $FE_{EtOH}$ and $C_2/C_1$ ratio at −1.14 V vs RHE.

FIG. 15 is a plot 1500 comparing the Faraday efficiency of each of the catalysts for the production of ethanol at $FE_{EtOH}$ and $C_2/C_1$ ratio at −1.14 V vs RUE. This comparison illustrates the difference in electrocatalytic $CO_2$ conversion activity of the samples. The $Cu/Cu_2O$ xerogel (sample 3) achieves a 7.49-fold and 5.5-fold enhancement in $FE_{EtOH}$ over planar Cu and planar $Cu_2O$, respectively. In addition, the ratio of $C_2/C_1$ reached about 10, which is a 10.9-fold enhancement over planar Cu.

The xerogel structure significantly improved selectivity to ethanol, which increased $FE_{EtOH}$ from 7.5% (for planar $Cu_2O$) to 18.5% ($Cu_2O$ xerogel). Furthermore, introduction of greater numbers of $Cu^0$—$Cu^+$ interfaces dramatically lifted $C_2/C_1$ ratio and achieved the highest ethanol selectivity of the catalysts.

Figure 16:
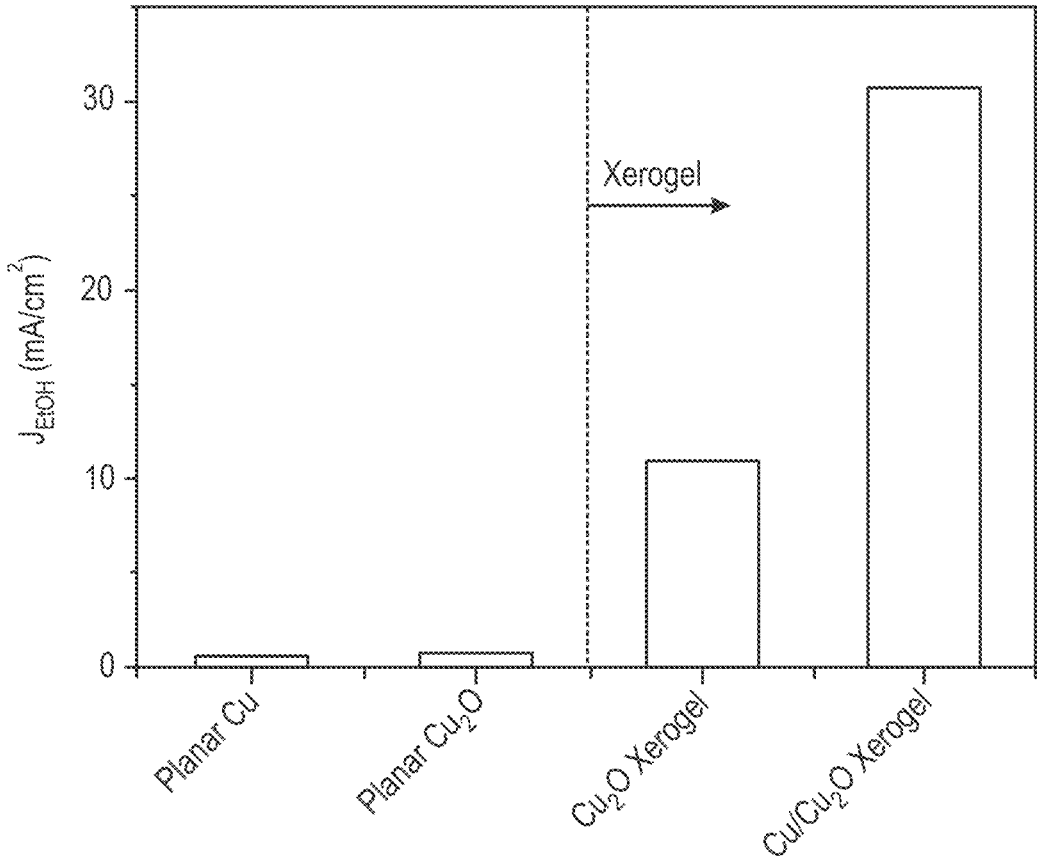
FIG. 16 is a plot comparing the current density profile of copper/copper oxide xerogel to the other catalysts.

FIG. 16 is a plot 1600 comparing the current density profile of copper/copper oxide xerogel to the other catalysts. Partial current density reveals actual productivity of an electrocatalyst. The $Cu/Cu_2O$ xerogel (sample 3) shows high productivity, as measured by current density ($J_{EtOH}$), versus other catalysts. A current density ($J_{EtOH}$) of 31.2 mA/cm$^2$ was achieved with the $Cu/Cu_2O$ xerogel (sample 3) at −1.14 V vs RHE. This value is 45.6 and 38.7 times higher than the current densities of planar Cu and planar $Cu_2O$, respectively.

Figure 17A:
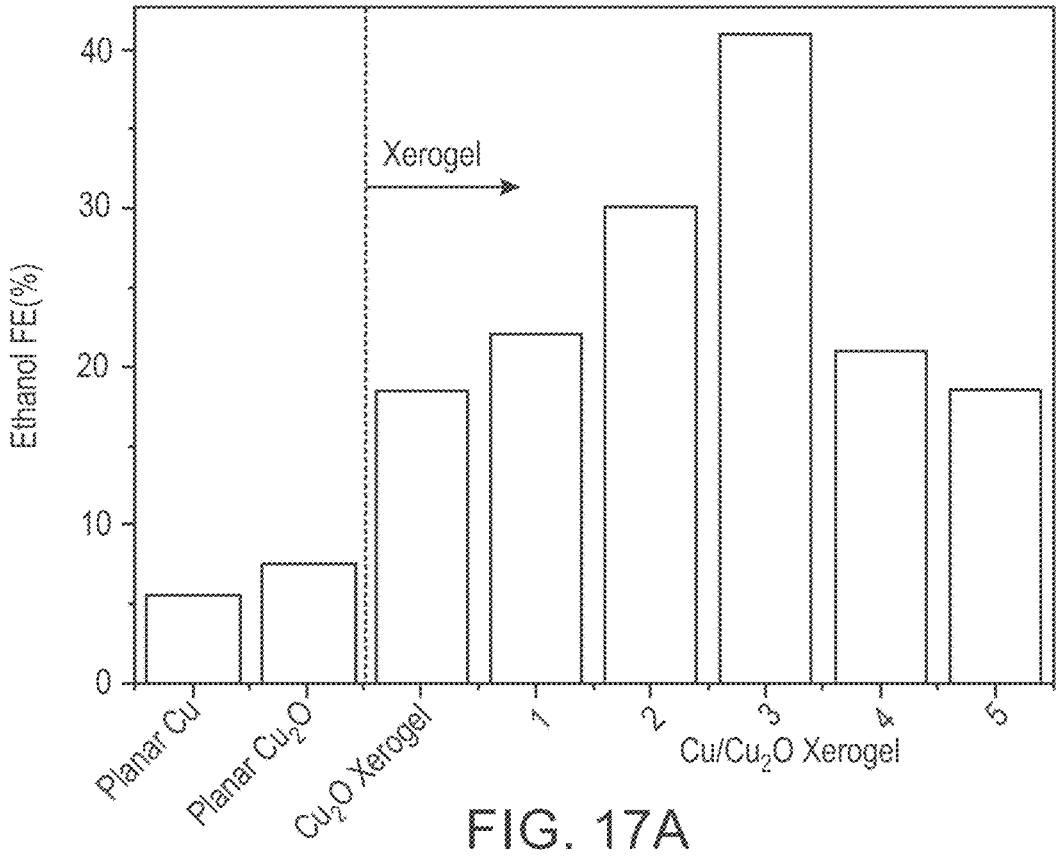
FIGS. 17A and 17B are plots comparing the electrocatalytic $CO_2$ conversion performance of the control catalyst with the various $Cu/Cu_2O$ xerogel samples.
Figure 17B:
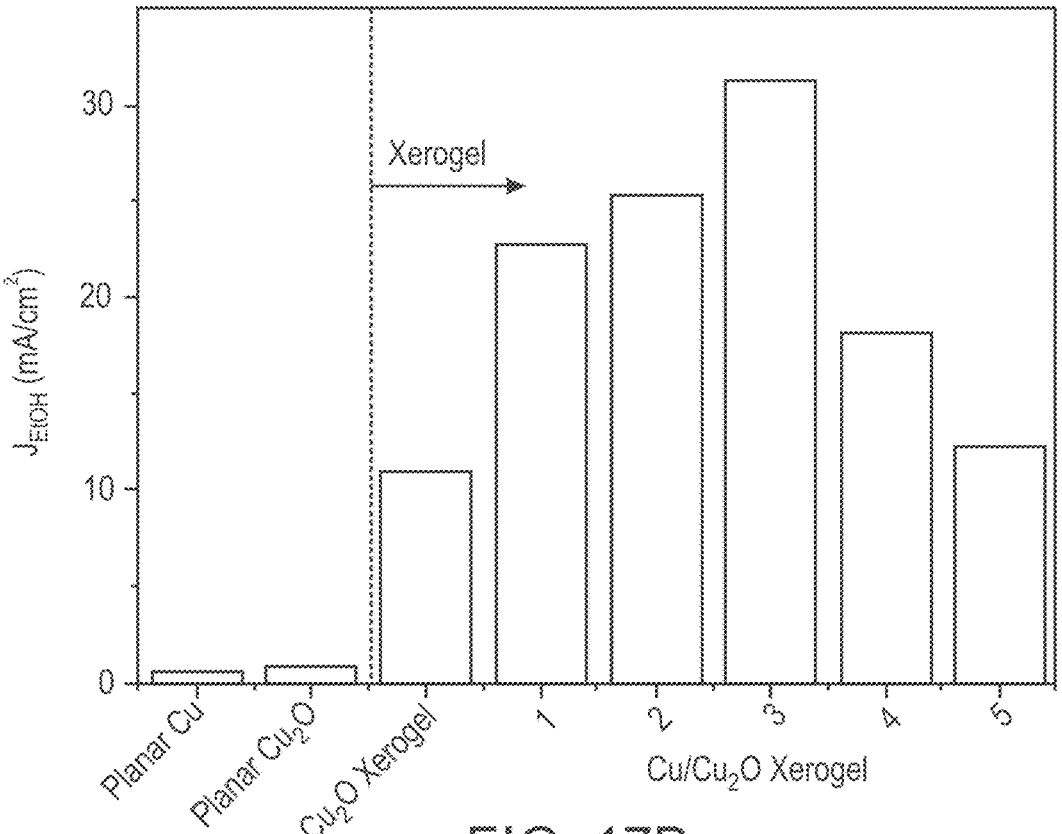

FIGS. 17A and 17B are plots comparing the electrocatalytic $CO_2$ conversion performance of the control catalyst with the various $Cu/Cu_2O$ xerogel samples. The performance of samples 1 to 5 of the $Cu/Cu_2O$ xerogel were measured to determine which ratio of Cu and $Cu_2O$ gave the best results. As sample 3 provided the best results, it was used for other tests described herein, such as those described with respect to 14A and 14B, among others.

Figure 18:
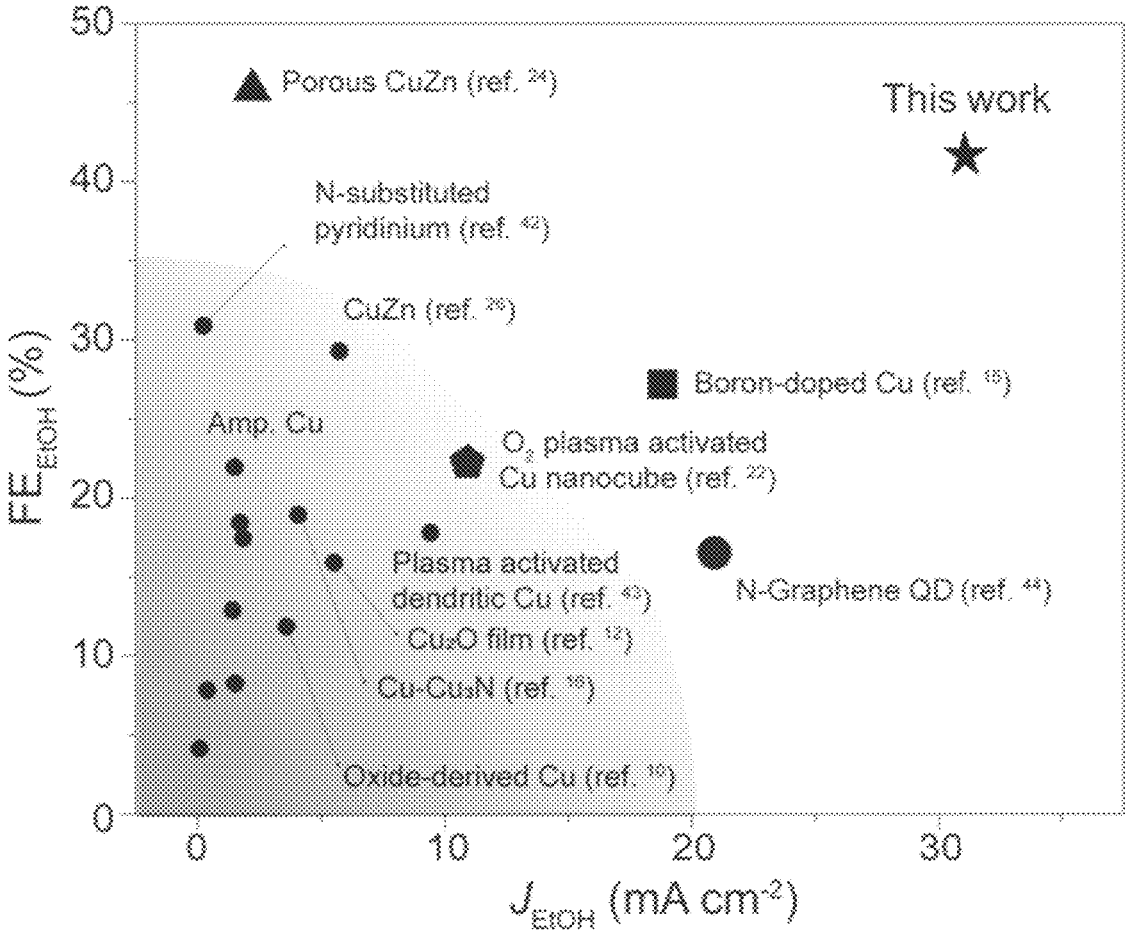
FIG. 18 is a plot comparing the xerogel $Cu/Cu_2O$ catalyst (sample 3) with other types of catalysts.

FIG. 18 is a plot comparing the xerogel $Cu/Cu_2O$ catalyst (sample 3) with other types of catalysts. The xerogel catalysts described herein provide the highest productivity of electrocatalytic $CO_2$ conversion to ethanol in H-cell of the currently tested catalyst, as well as other types of copper catalysts from the literature. The high productivity and selectivity to ethanol are believed to be to the large surface area provided by the xerogel, which increases active reaction sites over other types of catalysts.

Figure 19:
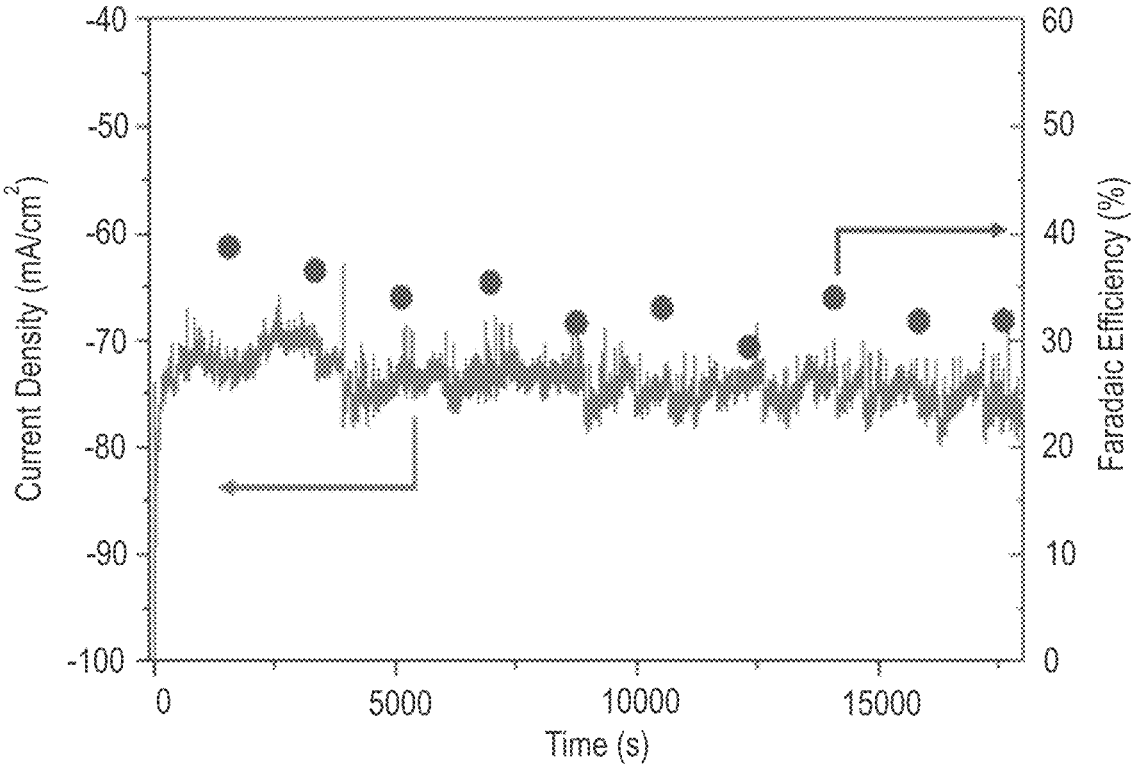
FIG. 19 is a plot of the stability of a copper/copper oxide xerogel.

FIG. 19 is a plot 1900 of the stability of a copper/copper oxide xerogel. The plot 1700 shows that the $Cu/Cu_2O$ xerogel (sample 3) exhibits relatively stable FE and partial current density during ethanol production. The $Cu/Cu_2O$ xerogel (sample 3) retained 80.1% of its $FE_{EtOH}$ with a stable total current density following 5 h electrolysis.

Figure 20A:
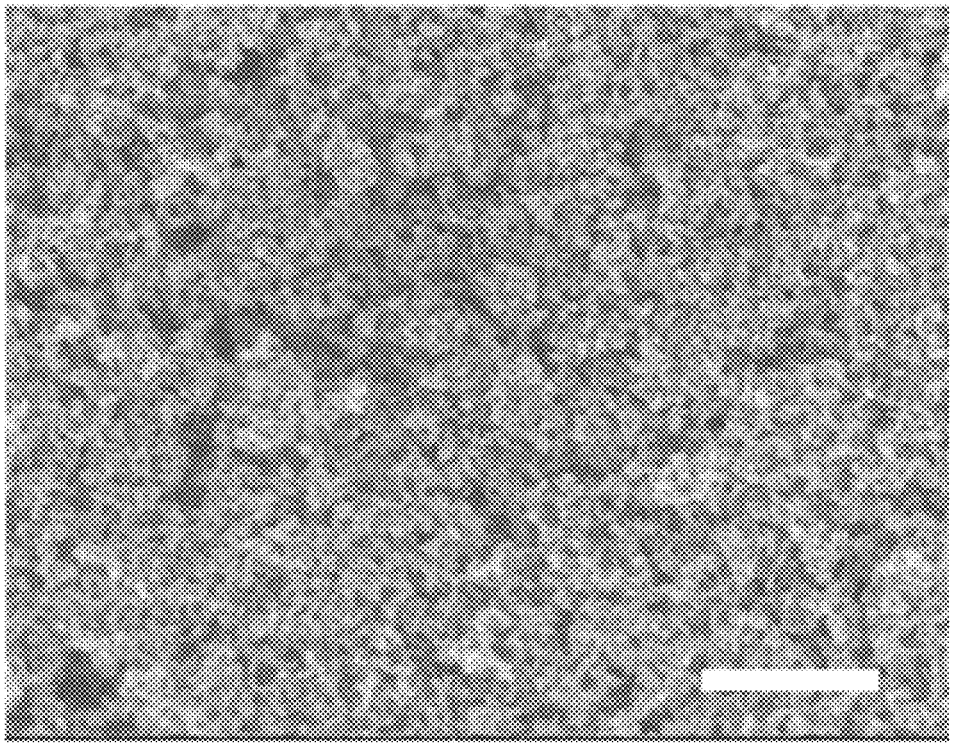
FIGS. 20A and 20B are transmission electron micrographs of a xerogel catalyst before and after 5 hours of electrolysis.
Figure 20B:
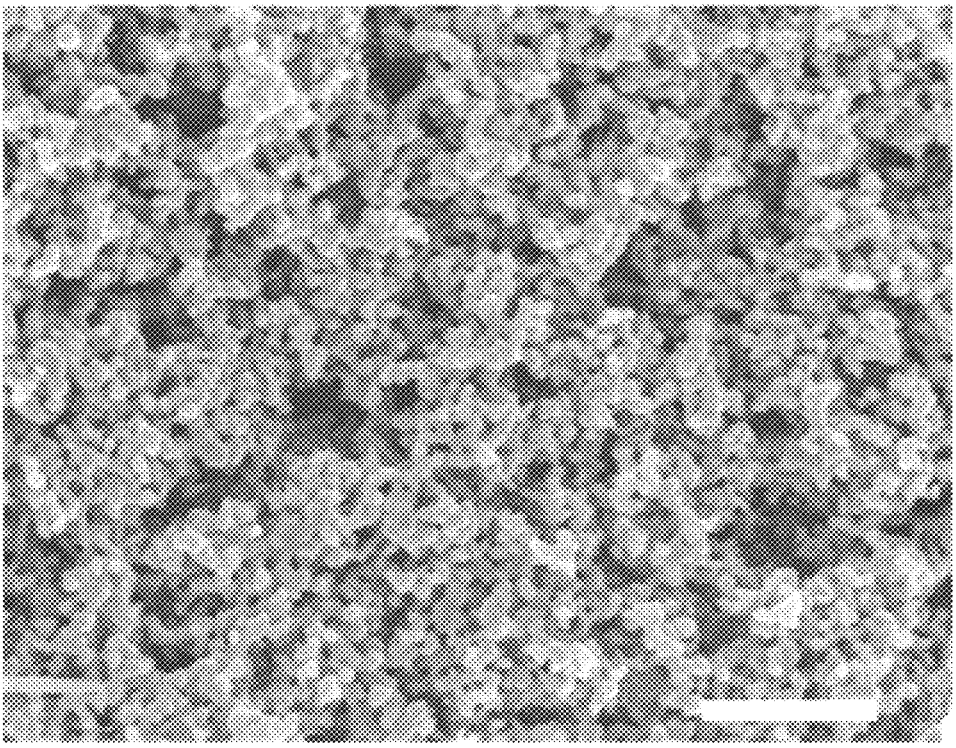
Figure 21A:
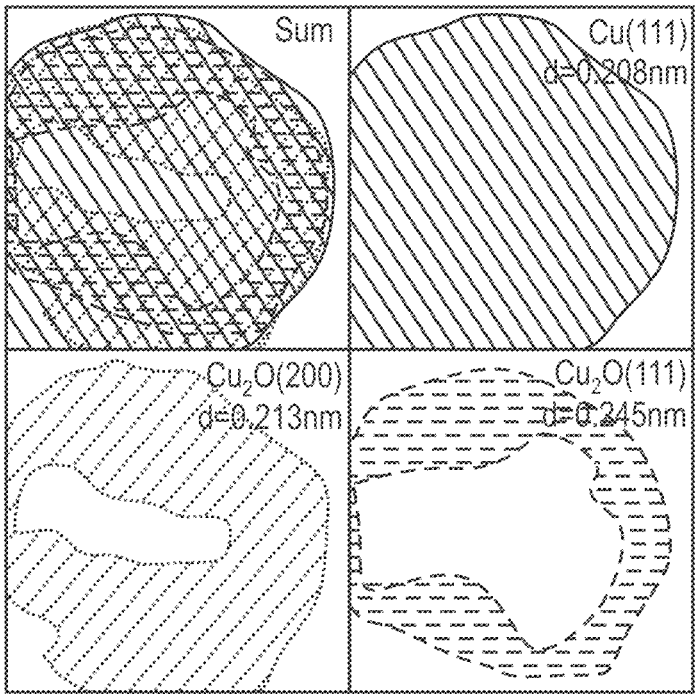
FIGS. 21A and 21B are HR-TEM inverse-FFT mapping images of the xerogel catalyst before and after 5 hours electrolysis.
Figure 21B:
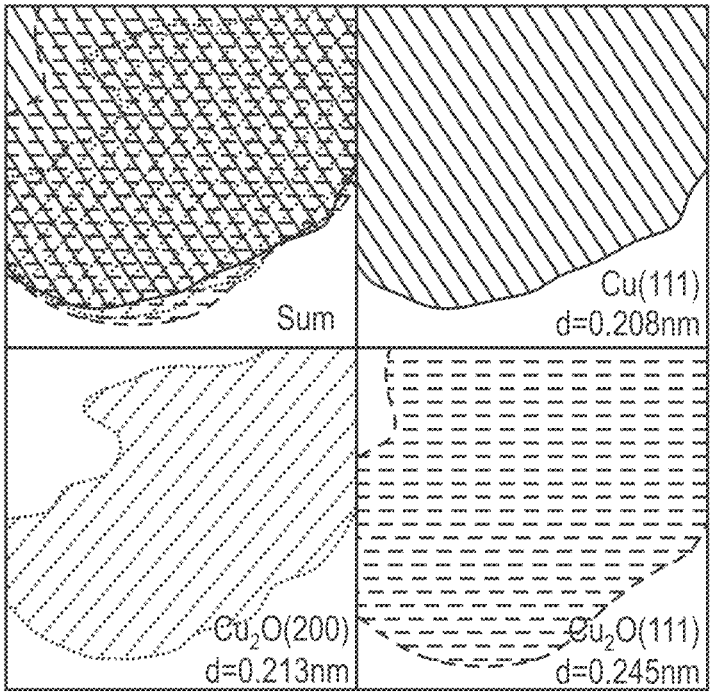
Figure 22A:
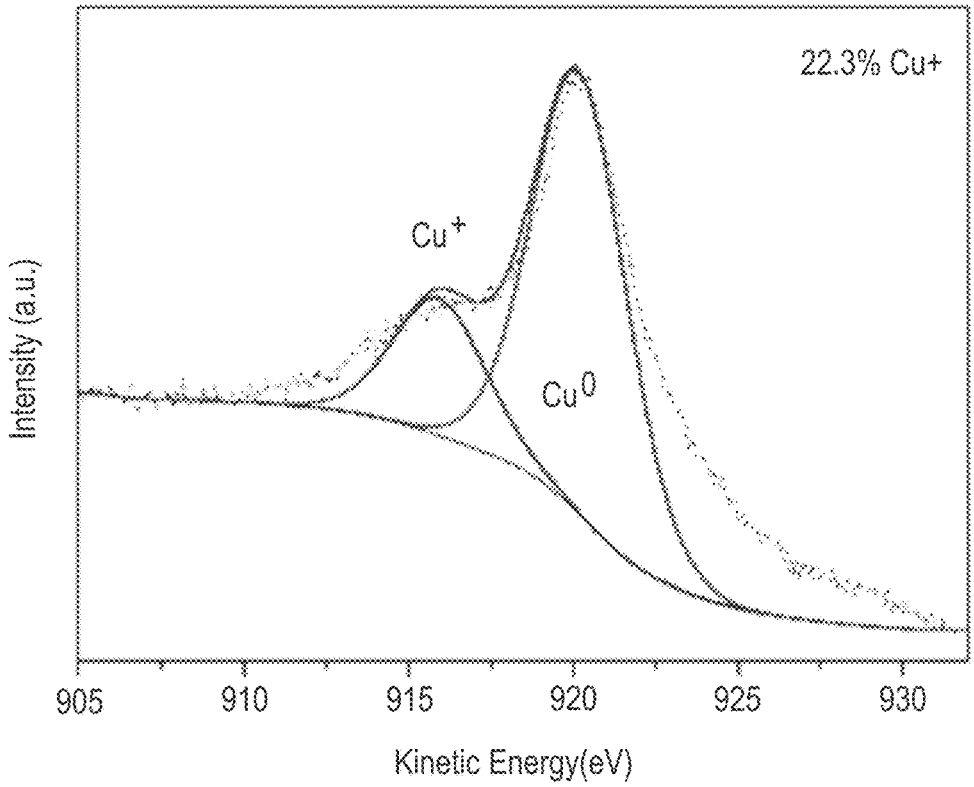
FIGS. 22A and 22B are XPS Auger copper LMM spectra of the xerogel catalyst before and after 5 hours of electrolysis.
Figure 22B:
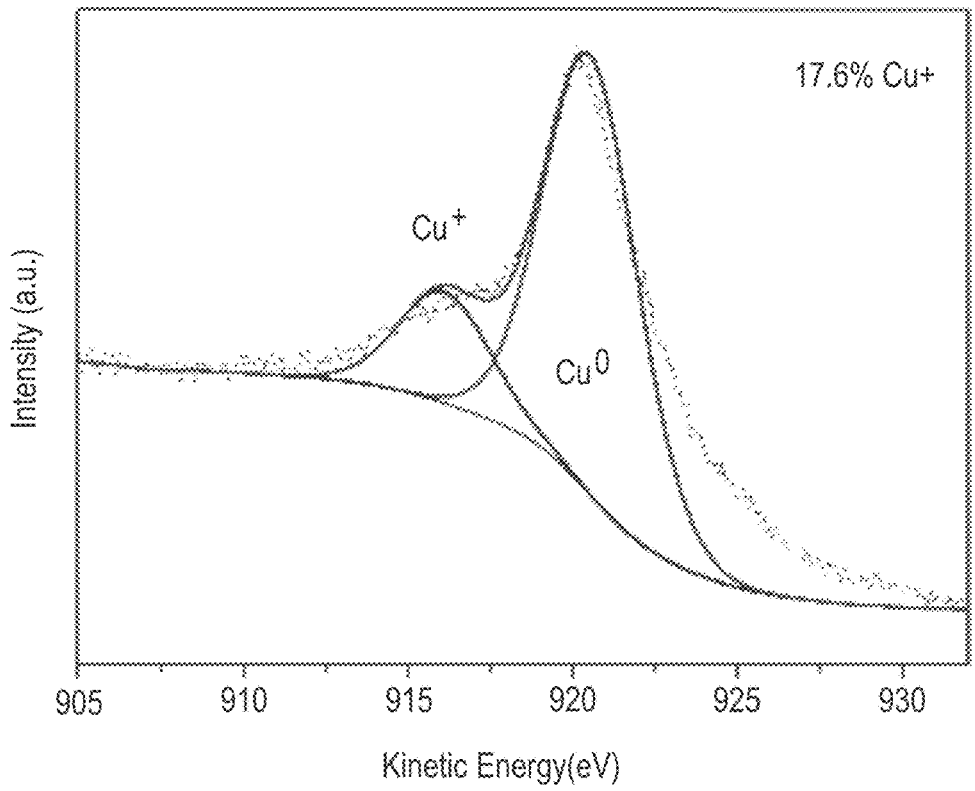

The stability was further explored by imaging the $Cu/Cu_2O$ xerogel (sample 3) catalyst before and after five hours of operation as shown in FIGS. 20A, 20B, 21A, 21B, 22A, and 22B. FIGS. 20A and 20B are transmission electron micrographs of the $Cu/Cu_2O$ xerogel (sample 3) catalyst before and after 5 hours of electrolysis. FIGS. 21A and 21B are HR-TEM inverse-FFT mapping images of the $Cu/Cu_2O$ xerogel (sample 3) catalyst before and after 5 hours electrolysis. FIGS. 22A and 22B are XPS Auger copper LMM spectra of the xerogel catalyst before and after 5 hours of electrolysis. After five hours of electrolysis, the $Cu/Cu_2O$ xerogel (sample 3) maintained a nearly uniform mixture of $Cu^0$ and $Cu^+$. Some morphological changes were seen due to aggregation and sintering. The stability is likely due to the stabilizing effect of the KCl electrolyte on the $Cu_2O$.

Figure 23:
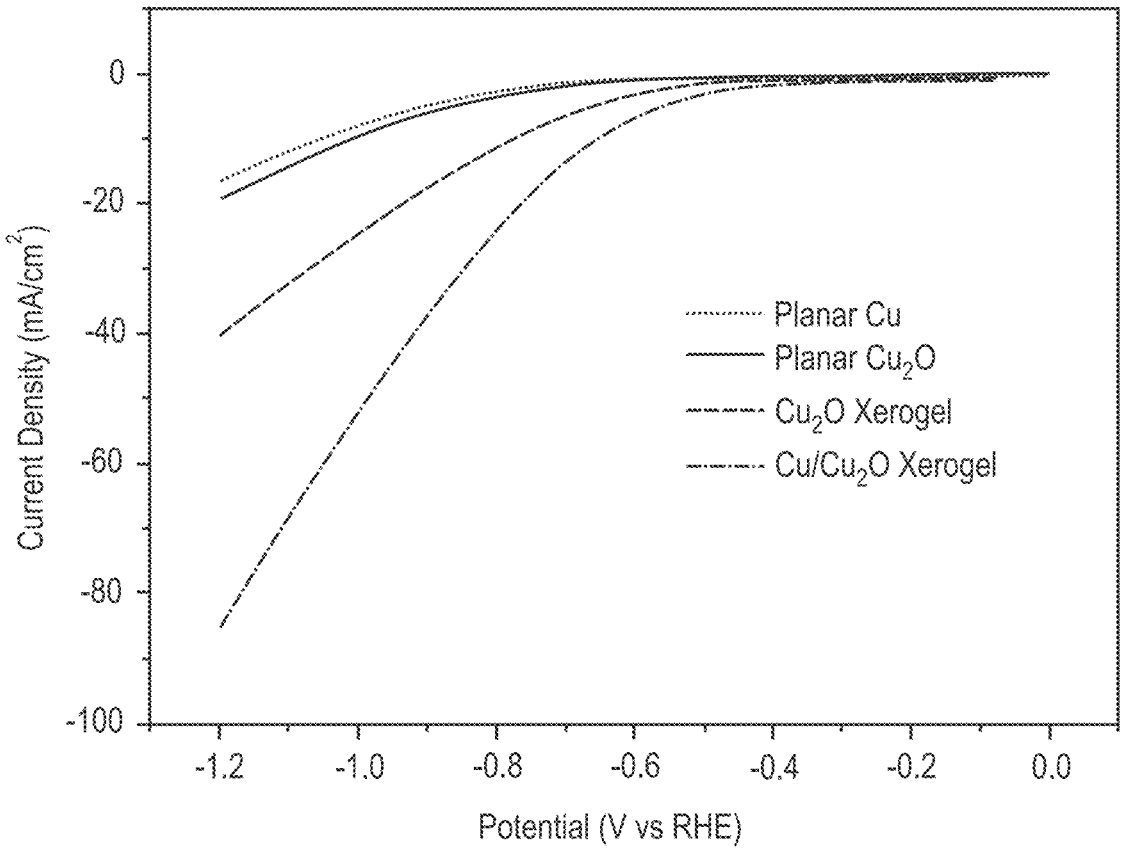
FIG. 23 is an LSV plot comparing the electrochemical analysis results of four types of copper catalysts.

FIG. 23 is an LSV plot 2300 comparing the electrochemical analysis results of four types of copper catalysts. The electrochemical analysis was performed to explain the high performance of the $Cu/Cu_2O$ xerogel (sample 3). Linear sweep voltammetry (LSV) displays much higher current density with the $Cu/Cu_2O$ xerogel compared to the control samples during the overall potential range. In addition, the onset potential was −0.398 V vs RHE for $Cu/Cu_2O$ xerogel (sample 3), which is less negative than those of other catalysts (−0.488 V, −0.623 V, −0.658 V vs RHE for $Cu_2O$ xerogel, planar $Cu_2O$ and planar Cu, respectively).

Figure 24:
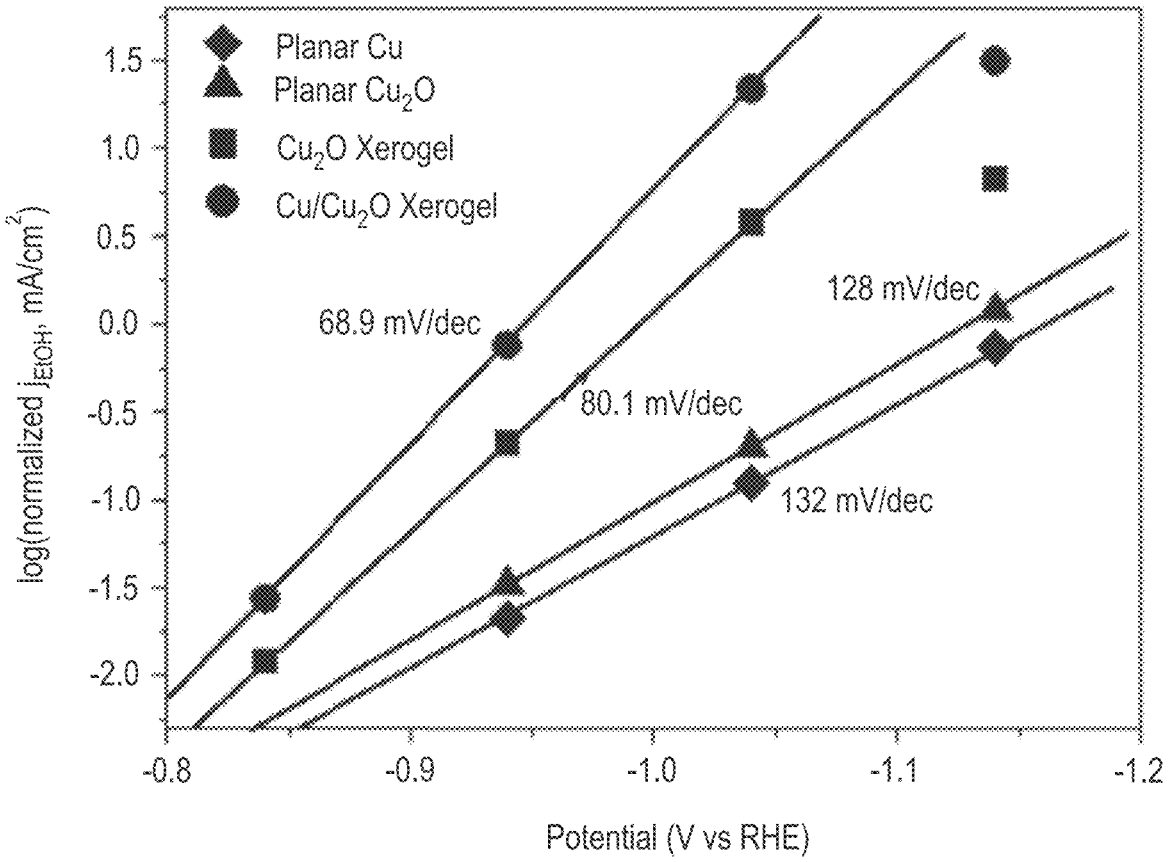
FIG. 24 is a Tafel plot from the electrochemical analysis of the four types of copper catalysts, including the $Cu/Cu_2O$ xerogel (sample 3).

FIG. 24 is a Tafel plot 2400 from the electrochemical analysis of the four types of copper catalysts, including the $Cu/Cu_2O$ xerogel (sample 3). The Tafel plot 2400 is based on the relationship of the rate of an electrochemical reaction to the overpotential for the electrochemical reaction. The Tafel plot 2400 for ethanol production was determined to provide kinetic insight from current density for ethanol at various overpotentials. The slopes of the lines in the Tafel plot were 68.9 and 132 mV per decade ($dec^{-1}$) for $Cu/Cu_2O$ xerogel (sample 3) and planar Cu, respectively, indicating that the overall rate-determining step has changed by introducing the xerogel structure and the $Cu^0$—$Cu^+$ interfaces. Other studies have indicated that these slopes are similarly observed in CO reduction (CO to $C_2$ products, 68.9 mV $dec^{-1}$) and the first electron transfer step in $CO_2$ reduction ($CO_2+e \rightarrow CO_2^-$, 132 mV $dec^{-1}$). This implies that the $Cu/Cu_2O$ xerogel exhibits faster kinetics than other catalysts.

Figure 25:
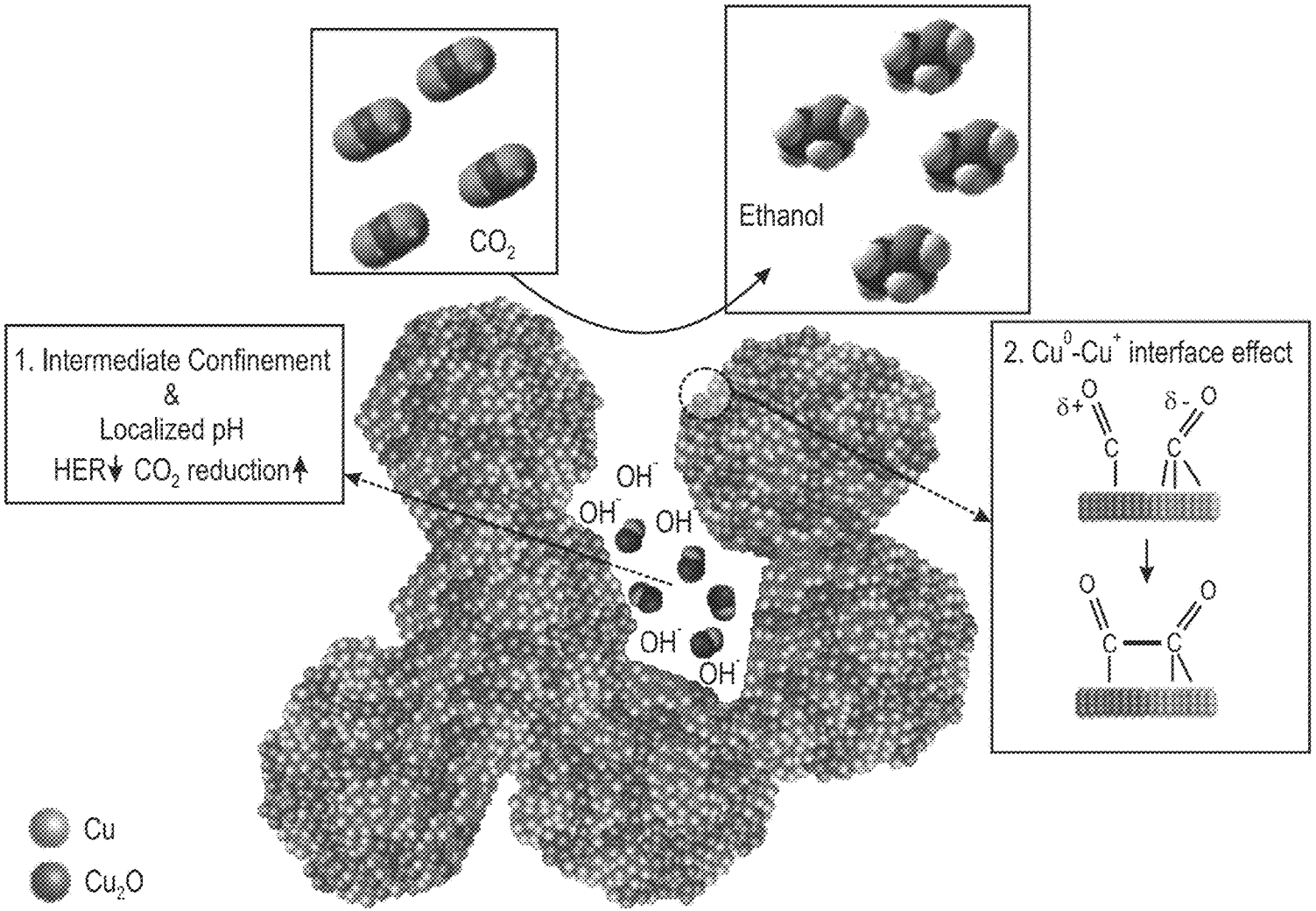
FIG. 25 is a schematic diagram of a proposed mechanism of electrochemical $CO_2$ conversion on a copper/copper oxide xerogel.

FIG. 25 is a schematic diagram of a proposed mechanism 2500 of the electrochemical conversion of $CO_2$ to ethanol on the $Cu/Cu_2O$ xerogel. The porous structure of the $Cu/Cu_2O$ xerogel may improve $CO_2$ reduction selectivity by a high local pH generated via the accumulation of hydroxide ions from $CO_2$ reduction and HER by-products. The high local pH improves the kinetics of proton adsorption, which may help to suppress HER. In addition, the high concentration of the local intermediates in the confined structure promotes C—C dimerization for $C_2$ production. Further, the increase in the $Cu^0$—$Cu^+$ interfaces improves the C—C dimerization kinetics and thermodynamics by a combination of positively and negatively charged CO binding on $Cu^+$ and $Cu^0$, respectively. Finally, introduction of the increased $Cu^0$—$Cu^+$ interfaces on xerogel structure exhibits substantial increases in $C_2$ (ethanol, ethylene) production.

Figure 26:
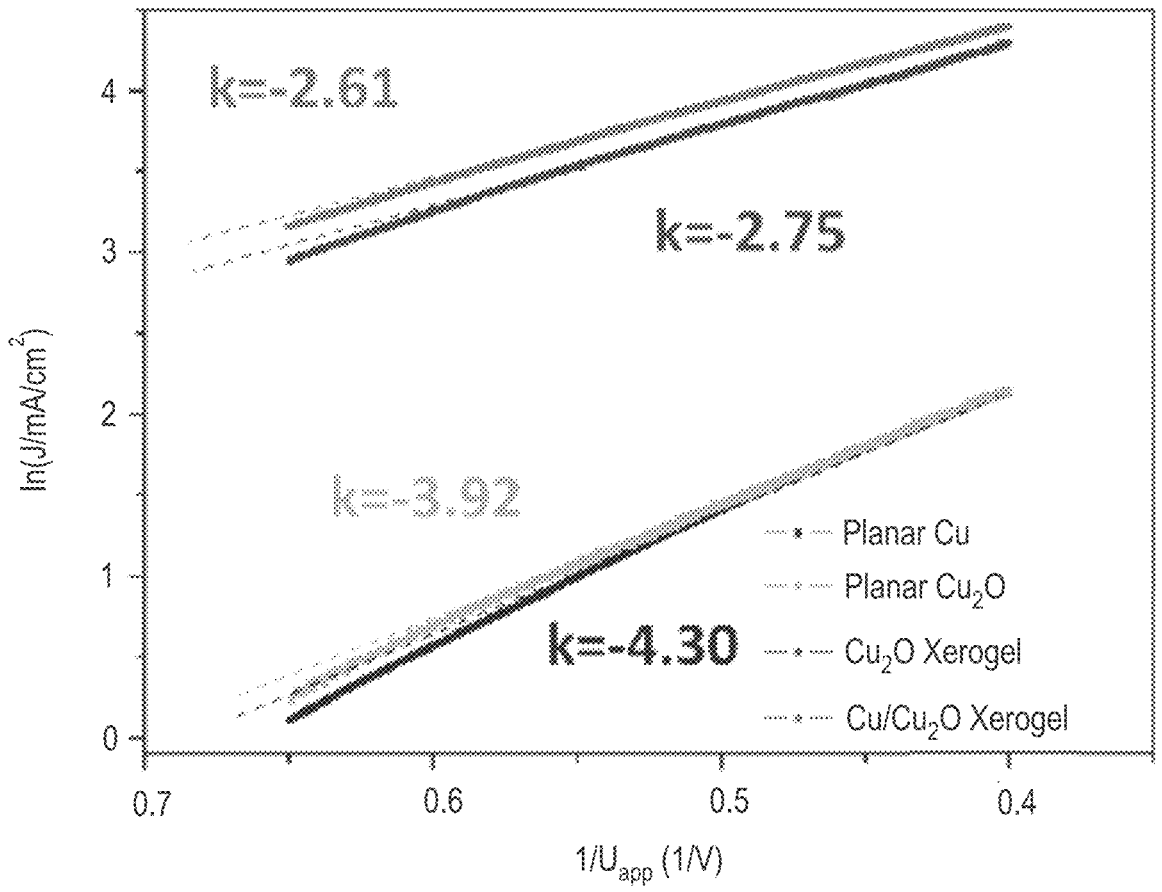
FIG. 26 shows Arrhenius 2600 of the $Cu/Cu_2O$ xerogel (sample 3) and control samples from LSV.

FIG. 26 shows Arrhenius plots 2600 of the $Cu/Cu_2O$ xerogel (sample 3) and control samples from LSV. The Arrhenius plot 2600 can be used to provide the overall activation energy from the absolute value of the slope. The $Cu/Cu_2O$ xerogel (sample 3) shows and absolute value of the slope of 2.61, which is 1.65 times lower than planar Cu. This helps to explain the high intrinsic electrochemical activity.

Figure 27A:
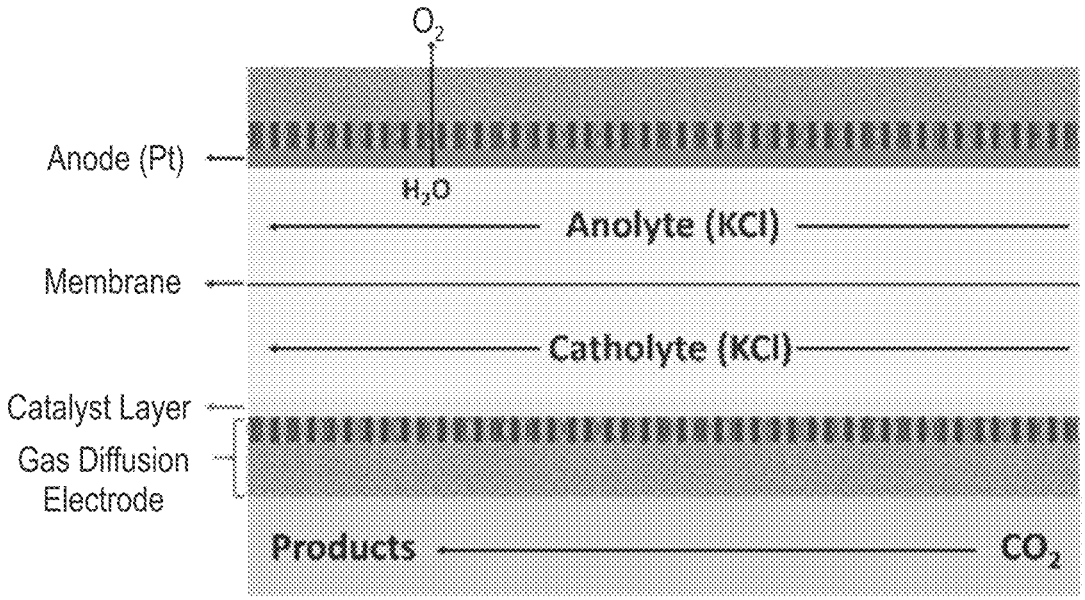
FIGS. 27A and 27B are a schematic diagram showing the flow of material in the reactor in comparison to scanning electron micrograph of the $Cu/Cu_2O$ xerogel (sample 3) catalyst.
Figure 27B:
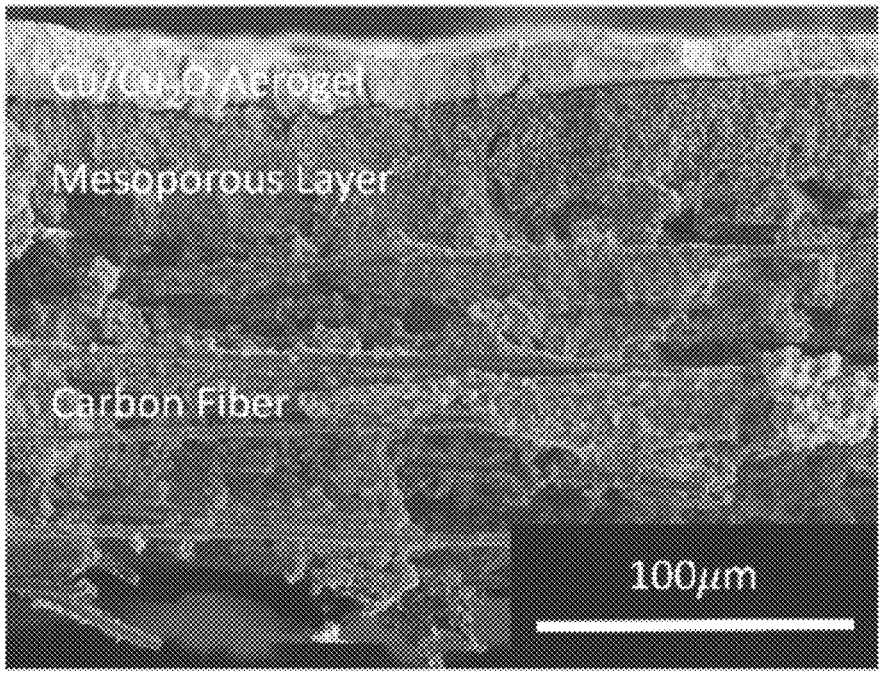

FIGS. 27A and 27B are a schematic diagram showing the flow of material in the reactor in comparison to scanning electron micrograph of the $Cu/Cu_2O$ xerogel (sample 3) catalyst. To further enhance current density to ethanol, the $Cu/Cu_2O$ xerogel (sample 3) was tested in a flow cell reactor as a gas diffusion electrode (GDE). The $Cu/Cu_2O$ xerogel (sample 3) deposited on hydrophobic polytetrafluoroethylene (PTFE) coated carbon paper was investigated in flow cell reactor composed of one $CO_2$ gas and two liquid electrolytes (catholyte and anolyte) compartments. At the boundary of catalyst, $CO_2$ gas and electrolyte, three-phase reaction occurs which can overcome serious limitation of H-cell reactor. High current density could be obtained by removing limitation on gaseous $CO_2$ solubility on electrolyte. Also, high porosity of $Cu/Cu_2O$ xerogel 3 will gives advantage of exiting the gaseous product rapidly without blocking of bubble while achieving high current density. Cross-sectional SEM image in FIG. 27B shows a GDE which is composed of carbon fiber and microporous layer with the highly porous $Cu/Cu_2O$ xerogel (sample 3) catalyst.

Figure 28A:
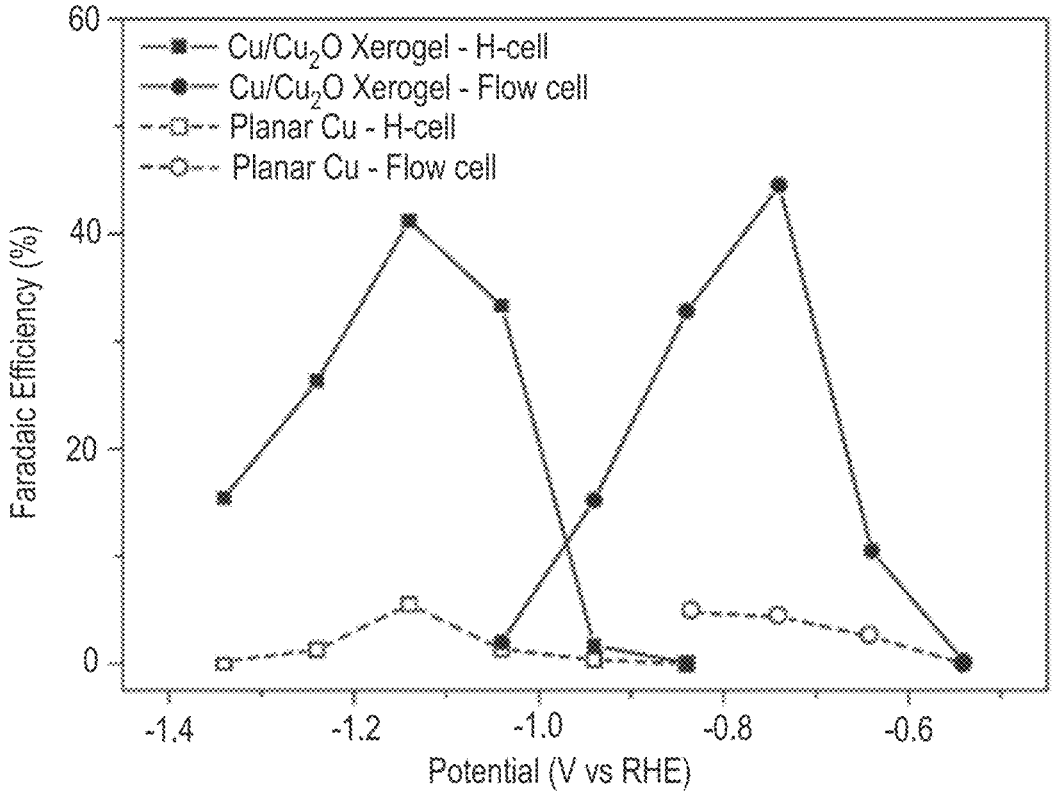
FIGS. 28A and 28B are plots showing the electrocatalytic performance of the copper/copper oxide xerogel in comparison to other copper materials.
Figure 28B:
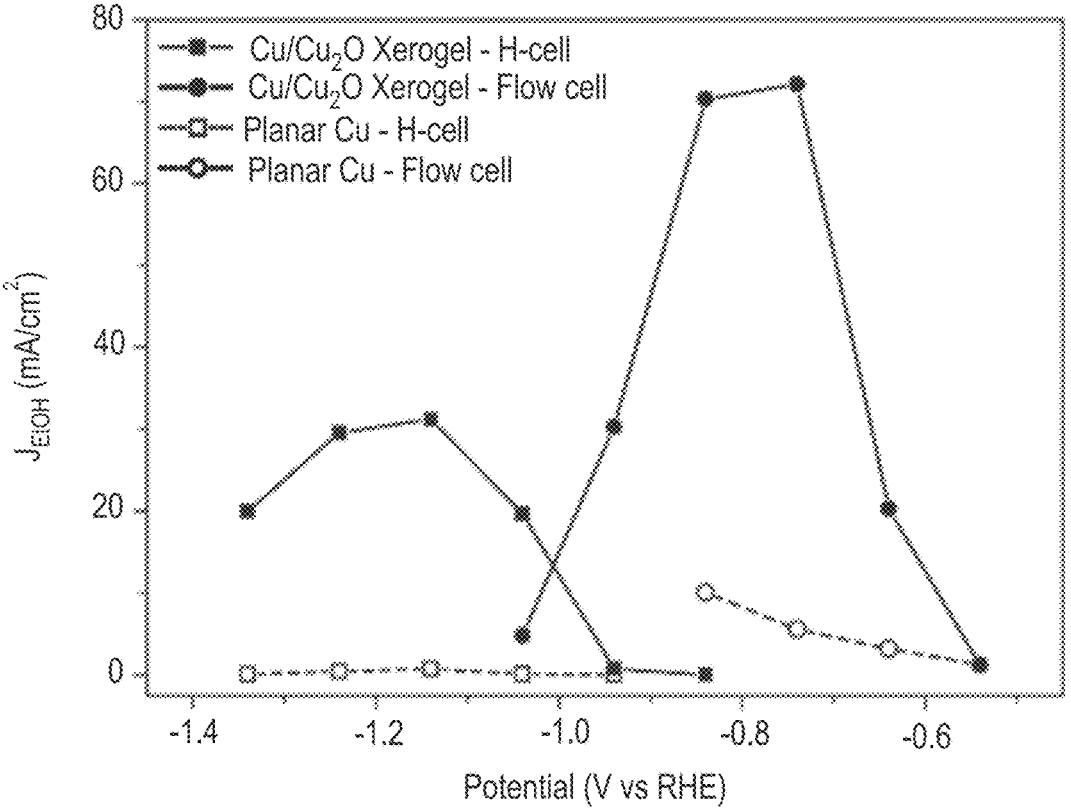

FIGS. 28A and 28B are plots showing the electrocatalytic performance of the copper/copper oxide xerogel in comparison to other copper materials. FIG. 28A shows FE to ethanol using planar Cu and $Cu/Cu_2O$ xerogel (sample 3) in the H-cell reactor and the flow cell reactor. Both the planar Cu and the $Cu/Cu_2O$ xerogel (sample 3) exhibit less negative onset potential for ethanol production in flow cell.

However, selectivity to ethanol reached to about 45% in flow cell with $Cu/Cu_2O$ xerogel (sample 3) under −0.74 V vs RUE. As shown in FIG. 28B, at this potential, the highest $J_{EtOH}$ of 72.1 mA/cm$^2$ was achieved, which is a 2.31-fold enhancement over the case of H-cell reactor. This high productivity to ethanol is attributed to the synergetic effects of the efficient $Cu/Cu_2O$ xerogel (sample 3) catalyst and the systematic advantages of a flow cell reactor.

Figure 29:
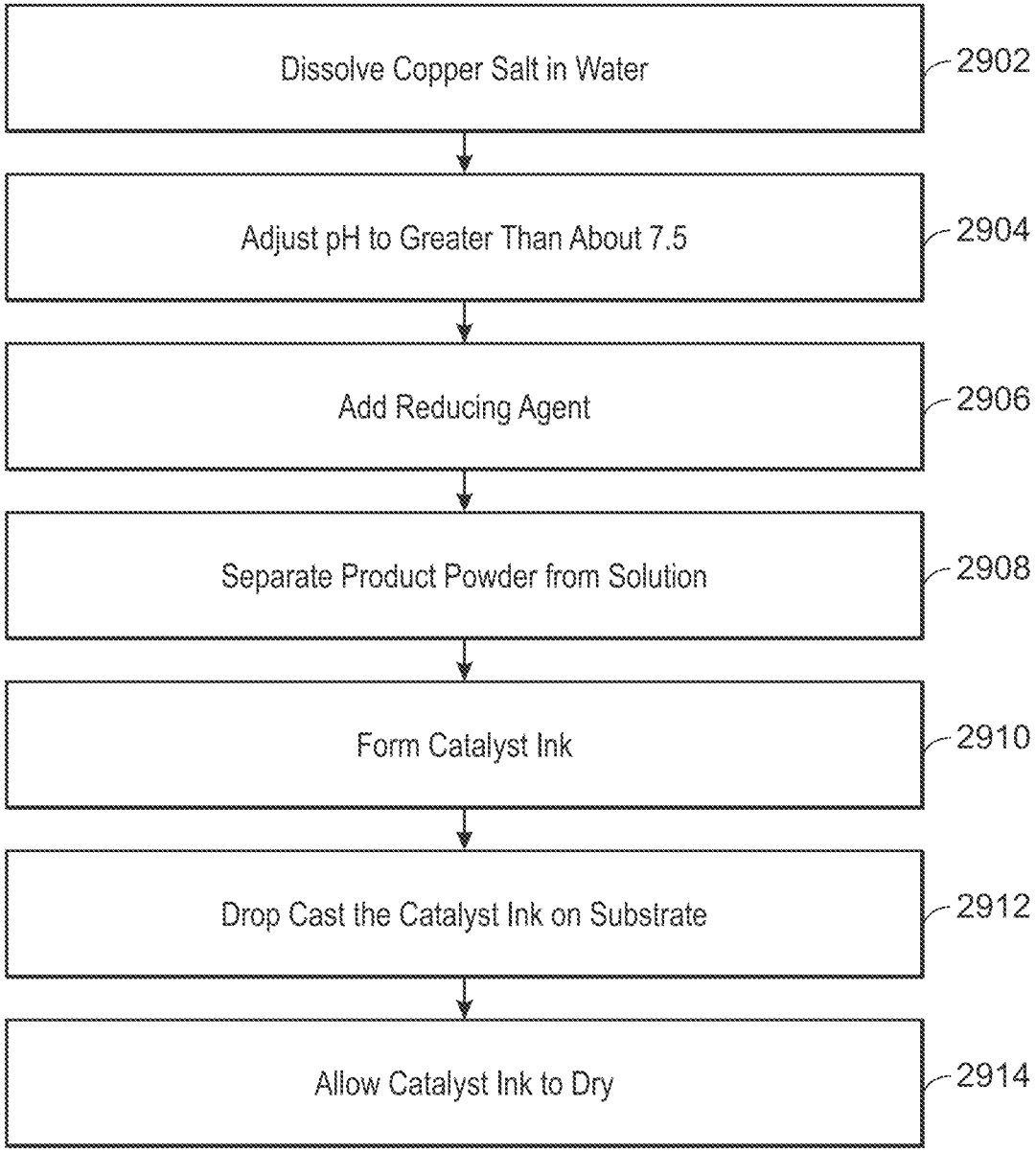
FIG. 29 is a process flow diagram of a method for forming a copper/copper oxide xerogel catalyst for electrocatalytic production of ethanol from atmospheric $CO_2$.

FIG. 29 is a process flow diagram of a method 2900 for forming a copper/copper oxide xerogel catalyst for electrocatalytic production of ethanol from atmospheric $CO_2$. As used herein the copper/copper oxide xerogel catalyst is an electrocatalytic catalyst that may be used as a solid electrode catalyst, a gas diffusion electrode, or in other forms. The method 2900 begins at block 2902 with the dissolution of copper ions in water. The copper ions can be in the form of copper chloride, or other copper salts, such as copper nitrate, copper sulfate, or copper acetate, among others.

At block 2904, the pH is adjusted to be basic, for example, by the addition of sodium hydroxide. In various embodiments, the pH may be adjusted to be less than about 7.0, less than about 6.5, less than about 6.0, or lower. The adjustment of the pH may trigger the precipitation of copper salts, and the formation of a gel.

At block 2906, a reducing agent is added. In some embodiments, the reducing agent may be sodium borohydride ($NaBH_4$). Other reducing agents that may be used in embodiments include, LiBH4, NaH, or LiH, among others.

At block 2908, the resulting product is separated from the solution and dried to form a powder. In some embodiments, this may be performed by centrifugation, or filtration, among other techniques. The separated product can be rinsed, for example, with water, alcohols, or both.

At block 2910, a catalyst ink can be formed by suspending the powder in a solvent. In some embodiments, the solvent is an alcohol, such as methanol, ethanol, or isopropanol. In some embodiments, a material is added to the solvent to assist the dissolution, such as an ionomer. In some embodiments, the material is a sulfonated tetrafluoroethylene, such as a Nafion® type available polymer from Chemours of Wilmington, Delaware, USA.

At block 2912, the catalyst ink can be dropped cast on a substrate to form an electrode. In various examples, the substrate is conductive allowing its use as an electrode. In some examples, the substrate is a carbon film, a carbon rod, a carbon block, and the like. The drop casted catalyst ink is allowed to dry on the substrate. In some embodiments, the drying is performed under an inert atmosphere at ambient conditions. In other embodiments, the drying is performed at an elevated temperature.

The catalyst is not limited to being formed on a conductive substrate, but may be used as a gas diffusion electrode (GDE) deposited on a hydrophilic PTFE paper.

Methods

Synthesis of $Cu/Cu_2O$ Xerogel and $Cu_2O$ Xerogel 15 mL of $CuCl_2$ (0.1 M) and 15 mL of NaOH (0.2 M) were added into 150 mL of distilled (DI) water with vigorous stirring under nitrogen atmosphere for 30 min. 150 μL of ethanol and controlled amount of $NaBH_4$ in 25 mL of DI water were quickly added into above solution. Amount of $NaBH_4$ was 12.5 milligrams (mg), 25 mg, 37.5 mg, 50 mg, 62.5 mg, 70 mg for samples 1 to 5 of the $Cu/Cu_2O$ (copper/copper (I) oxide) xerogel and $Cu_2O$ (copper (I) oxide) xerogel, respectively. After 30 min, the black colored powder was obtained by centrifugation and rinsing with water and ethanol.

Preparation of Planar Cu and Planar $Cu_2O$

Planar Cu was prepared by electropolishing copper foil in phosphoric acid (85% in water) potentiostatically at 2.1 V vs counter electrode. The planar $Cu_2O$ electrode were fabricated using electrodeposition method at 0.25 V vs ME in 0.5 M $CuSO_4$ with lactic acid and 5 M NaOH.

Preparation Working Electrode

The catalyst ink was prepared by dispersion of 10 mg of the sample powder with 20 μL Nafion solution (5%) in 1 mL methanol which was ultrasonicated for 1 h. 71 μL of catalyst ink was drop-casted on the 1 $cm^2$ carbon paper and dried for 6 h.

Electrochemical Measurements

Electrochemical tests were performed in an H-cell reactor, which is composed of two compartments separated by a proton exchange membrane. 50 mL of 0.1 M KCl electrolyte was injected for each compartment and purged with $CO_2$ gas for 30 min before $CO_2$ reduction test. Pt coil and Ag/AgCl (3 M KCl saturated) electrode was used as a counter and reference, respectively. First, working electrode was electrochemically reduced using the cyclic voltammetry (CV) method in the range of −0.5~−2.0 V vs RHE at the rate of 0.1 V $s^{-1}$ for 5 cycle. During the constant potential with iR-correction, the gas products were detected by gas chromatograph (Agilent 7890 GC) which is connected to reactor. Liquid products were quantified with 1H nuclear magnetic resonance (NMR Bruker AVANCE III HD). 630 μL of electrolyte after electrolysis mixed with 70 μL of deuterated water ($D_2O$), 35 μL of 50 mM phenol and 10 mM DMSO for reference.

The potential was converted to RHE using following equation:

$$E_{RHE} = E_{AgCl} + 0.059\ \mathrm{pH} + 0.209\ \mathrm{V}$$

The FE for products was calculated using the following equation:

$$FE(\%) = \mathrm{nF} \times \mathrm{V}^{*} 100 j_{Tot}^{-1}$$

Flow Cell Reactor Electrolysis

Carbon paper with a microporous layer (Sigracet 39 BC, Fuel cell store) was used as a gas diffusion electrode (GDE). The E-beam evaporated Pt on GDE was used as the counter electrode and Ag/AgCl as a working electrode. $CO_2$ electrolysis was tested in flow cell reactor, which is made of polyetheretherketone (PEEK) and silicone gasket for sealing. Gas flow rate was controlled to 10 sccm via a mass flow controller. $CO_2$ gas flowing at the backside of cathode GDE was connected to GC and backside of anode GDE was opened to air. The catholyte and anolyte were separated and flow rate was 2 mL $min^{-1}$. A 1M KCl solution was used as an electrolyte with Nafion proton exchange membrane.

Characterization

The prepared samples were characterized using scanning microscope (FEI Magellan 400), a transmission electron microscope (Tecnai G2 F30), an X-Ray diffractometer (Rigaku SmartLab), and an X-ray photoelectron spectroscope (Axis-Supra). Inverse-fast Fourier transformation (Inverse-FFT) mapping was conducted from FFT data by Gatan Digital Microscopy 3. The double-layer capacitance measurement for ECSA was conducted by CV in a 0.1 M KCl electrolyte. The double-layer capacitance was determined by the value of the slope of the linear fits, and it was considered to be proportional to the ECSA.

Embodiments

An embodiment described in examples herein provides an electrocatalytic catalyst. The electrocatalytic catalyst includes a xerogel including copper (I) oxide and copper.

In an aspect, the xerogel includes a ratio of copper (I) to copper (0) of between 10% and 40% copper (I). In an aspect, the xerogel includes a ratio of copper (I) to copper (0) of 20% copper oxide.

In an aspect, the xerogel is cast on a conductive substrate to form a catalytic electrode. In an aspect, the conductive substrate includes carbon. In an aspect, the electrocatalytic catalyst includes a partial current density for production of ethanol of greater than about 30 mA/cm2.

In an aspect, the xerogel is drop casted on a nonconductive substrate. In an aspect, the xerogel includes a gas diffusion electrode. In an aspect, the electrolytic catalyst includes a partial current density for production of ethanol of greater than about 70 mA/cm2.

In an aspect, the xerogel includes a main domain size for domains of copper of between 8 nm and 8.6 nm. in an aspect, the xerogel includes a main domain size for domains of the copper oxide of between 5 nm and 6 nm.

Another embodiment described herein provides a method for making an electrocatalytic catalyst. The method includes dissolving a copper salt in a water solution, adjusting the pH of the water solution to be basic, adding a reducing agent to the water solution, and separating a product powder from the water solution, wherein the product powder is a xerogel including copper and copper (I) oxide.

In an aspect, the method includes dissolving copper sulfate in the water solution. In an aspect, the method includes adding sodium hydroxide to the water solution. In an aspect, the method includes, after adjusting the pH, stirring the water solution under an inert atmosphere for greater than 30 minutes.

In an aspect, the method includes adding the reducing agent by adding ethanol to the water solution, and adding sodium borohydride to the water solution. In an aspect, an amount of the sodium borohydride is adjusted to control a ratio of copper (I) to copper (0).

In an aspect, the method includes separating the product powder from the water solution by centrifugation. In an aspect, the method includes rinsing the product powder with water and ethanol.

In an aspect, the method includes forming a catalyst ink from the product powder. In an aspect, the method includes forming the catalyst ink by dispersing the product powder in methanol, and ultrasonicating the dispersion for about 1 hour.

In an aspect, the method includes adding an ionomer to the methanol with the product powder. In an aspect, the method includes adding a sulfonated tetrafluoroethylene as the ionomer. In an aspect, the method includes casting the catalyst ink on a substrate. In an aspect, the method includes placing droplets of the catalyst ink on a conductive carbon surface. In an aspect, the method includes placing droplets of the catalyst ink on a polytetrafluoroethylene paper. In an aspect, the method includes drying the catalyst ink on the substrate.

Other implementations are also within the scope of the following claims.

What is claimed is:

1. An electrocatalytic catalyst, comprising a xerogel comprising copper (I) oxide and copper, wherein the xerogel comprises a ratio of copper (I) to copper (0) of between 10% and 40% copper (I).

2. The electrocatalytic catalyst of claim 1, wherein the xerogel comprises a ratio of copper (I) to copper (0) of 20% copper oxide.

3. A catalytic electrode comprising:

the electrocatalytic catalyst of claim 1; and a conductive substrate, wherein the xerogel is cast on the conductive substrate to form a catalytic electrode.

4. The catalytic electrode of claim 3, wherein the conductive substrate comprises carbon.

5. The electrocatalytic catalyst of claim 1, comprising a partial current density for production of ethanol of greater than about 30 mA/cm2.

6. A catalytic electrode comprising:

the electrocatalytic catalyst of claim 1; and a nonconductive substrate, wherein the xerogel is drop casted on the nonconductive substrate.

7. The catalytic electrode of claim 6, wherein the catalytic electrode comprises a gas diffusion electrode.

8. The catalytic electrode of claim 6, comprising a partial current density for production of ethanol of greater than about 70 mA/cm2.

9. The electrocatalytic catalyst of claim 1, wherein the xerogel comprises a main domain size for domains of copper of between 8 nm and 8.6 nm.

10. The electrocatalytic catalyst of claim 1, wherein the xerogel comprises a main domain size for domains of the copper oxide of between 5 nm and 6 nm.

11. A method for making an electrocatalytic catalyst, comprising:

dissolving a copper salt in a water solution;

adjusting the pH of the water solution to be basic;

adding a reducing agent to the water solution; and separating a product powder from the water solution, wherein the product powder is a xerogel comprising copper and copper (I) oxide, wherein the xerogel comprises a ratio of copper (I) to copper (0) of between 10% and 40% copper (I).

12. The method of claim 11, comprising dissolving copper sulfate in the water solution.

13. The method of claim 11, comprising adding sodium hydroxide to the water solution.

14. The method of claim 11, comprising, after adjusting the pH, stirring the water solution under an inert atmosphere for greater than 30 minutes.

15. The method of claim 11, comprising adding the reducing agent by:

adding ethanol to the water solution; and adding sodium borohydride to the water solution.

16. The method of claim 15, wherein an amount of the sodium borohydride is adjusted to control the ratio of copper (I) to copper (0).

17. The method of claim 11, comprising separating the product powder from the water solution by centrifugation.

18. The method of claim 11, comprising rinsing the product powder with water and ethanol.

19. The method of claim 11, comprising forming a catalyst ink from the product powder.

20. The method of claim 19, comprising forming the catalyst ink by:

dispersing the product powder in methanol; and ultrasonicating the dispersion for about 1 hour.

21. The method of claim 20, comprising adding an ionomer to the methanol with the product powder.

22. The method of claim 21, comprising adding a sulfonated tetrafluoroethylene as the ionomer.

23. The method of claim 19, comprising casting the catalyst ink on a substrate.

24. The method of claim 23, comprising placing droplets of the catalyst ink on a conductive carbon surface.

25. The method of claim 23, comprising placing droplets of the catalyst ink on a polytetrafluoroethylene paper.

26. The method of claim 23, comprising drying the catalyst ink on the substrate.

* * * * *